US007481503B2

(12) United States Patent
Youngs et al.

(10) Patent No.: US 7,481,503 B2
(45) Date of Patent: Jan. 27, 2009

(54) STORAGE CABINET ASSEMBLY

(75) Inventors: Bradley D. Youngs, Byron Center, MI (US); Daniel N. Phillips, Kentwood, MI (US); Theodore M. Haan, Byron Center, MI (US); David J. Battey, Caledonia, MI (US); Michael G. Barney, Murrieta, CA (US); Koryn L. Smith, Grand Rapids, MI (US); Michael J. Feldpaush, Hastings, MI (US); Bruce W. DuVall, Jr., Wayland, MI (US)

(73) Assignee: Steelcase Inc., Grand Rapids, MI (US)

( * ) Notice: Subject to any disclaimer, the term of this patent is extended or adjusted under 35 U.S.C. 154(b) by 161 days.

(21) Appl. No.: 11/335,269

(22) Filed: Jan. 19, 2006

(65) Prior Publication Data

US 2007/0164642 A1 Jul. 19, 2007

(51) Int. Cl.
*E05B 65/46* (2006.01)

(52) U.S. Cl. ..... 312/221; 312/217

(58) Field of Classification Search ..... 312/215, 312/216, 217, 218, 219, 220, 221, 333
See application file for complete search history.

(56) References Cited

U.S. PATENT DOCUMENTS

| | | | |
|---|---|---|---|
| 278,892 | A | 6/1883 | Day |
| 481,720 | A | 8/1892 | Scottron |
| D26,770 | S | 3/1897 | Webber |
| 597,064 | A | 1/1898 | Larkins |
| 667,288 | A | 2/1901 | Bein |
| 1,003,966 | A | 9/1911 | Lathrop |
| 1,225,611 | A | 5/1917 | Gatlin |
| 1,235,476 | A | 7/1917 | Hoff |
| 1,472,841 | A | 11/1923 | Hunt |
| 1,523,653 | A | 1/1925 | Larson et al. |
| 1,613,447 | A | 1/1927 | Ellberg |
| 1,633,695 | A | 6/1927 | Colley |
| 1,644,503 | A | 10/1927 | Aumack |
| 1,714,909 | A | 5/1929 | Illmer |
| 1,716,274 | A | 6/1929 | Jones |
| 1,726,794 | A | 9/1929 | Anetsberger et al. |

(Continued)

FOREIGN PATENT DOCUMENTS

| | | |
|---|---|---|
| GB | 2 079 584 | 7/1980 |

(Continued)

OTHER PUBLICATIONS

Machine Translation of Lehmann, JP 10-205191.*

*Primary Examiner*—Janet M. Wilkens
(74) *Attorney, Agent, or Firm*—Price, Heneveld, Cooper, DeWitt & Litton, LLP

(57) ABSTRACT

A storage cabinet assembly includes a housing including a pair of sidewalls, a rear wall, and a top wall that cooperate with one another to form a storage area, and a base assembly supporting the housing. The base assembly includes a top wall and a bottom wall that mate together to form an interior space, and a plurality of corner support brackets supporting the top wall from the bottom wall. The storage cabinet assembly further includes a drop-in drawer arrangement, and a drawer interlock assembly adapted to prevent multiple drawers from being simultaneously moved to an opened position.

6 Claims, 13 Drawing Sheets

U.S. PATENT DOCUMENTS

| | | | |
|---|---|---|---|
| 1,729,475 | A | 9/1929 | Brainard et al. |
| 1,735,375 | A | 11/1929 | Card et al. |
| 1,787,786 | A | 1/1931 | Jerome |
| 1,798,182 | A | 3/1931 | Vance et al. |
| 1,818,829 | A | 8/1931 | Ulbrich |
| 1,909,847 | A | 5/1933 | Rand |
| 1,957,407 | A | 5/1934 | Finley |
| 1,984,345 | A | 12/1934 | Kennedy |
| 2,147,625 | A | 2/1939 | Brothers |
| 2,240,067 | A | 4/1941 | Bolesky et al. |
| 2,241,884 | A | 5/1941 | Noble |
| 2,242,593 | A | 5/1941 | Olson |
| 2,347,892 | A | 5/1944 | Derman |
| 2,387,741 | A | 10/1945 | Brownlie et al. |
| 2,441,721 | A | 5/1948 | Schroeder |
| 2,518,328 | A | 8/1950 | Janonis |
| 2,521,062 | A | 9/1950 | Hott |
| 2,532,942 | A | 12/1950 | Reimer |
| 2,539,726 | A | 1/1951 | Claghorn |
| 2,547,463 | A | 4/1951 | Haut |
| 2,559,579 | A | 7/1951 | Abrahamson |
| 2,686,704 | A | 8/1954 | Wolters |
| 2,698,094 | A | 12/1954 | Simpson |
| 2,709,123 | A | 5/1955 | Woina |
| 2,719,770 | A | 10/1955 | Roberts |
| 2,766,092 | A | 10/1956 | Dennison |
| 2,808,309 | A | 10/1957 | Magester |
| 2,855,263 | A | 10/1958 | Hutzelman |
| 2,858,179 | A | 10/1958 | Puerner et al. |
| 2,905,426 | A | 9/1959 | Ross |
| 2,966,384 | A | 12/1960 | Bergman |
| D189,918 | S | 3/1961 | Nordenson |
| 3,042,473 | A | 7/1962 | Vincens |
| 3,186,782 | A | 6/1965 | Ullman, Jr. |
| 3,195,966 | A | 7/1965 | Doherty |
| 3,223,466 | A | 12/1965 | Roberts |
| 3,239,298 | A | 3/1966 | McCarthy |
| 3,275,394 | A | 9/1966 | Massinger |
| 3,284,149 | A | 11/1966 | Lewin |
| 3,325,234 | A | 6/1967 | Lewin |
| 3,341,270 | A | 9/1967 | Sohl |
| 3,360,318 | A | 12/1967 | Studinski |
| 3,366,356 | A | 1/1968 | Fisher |
| 3,404,929 | A | 10/1968 | Wright et al. |
| 3,410,622 | A | 11/1968 | Stewart |
| 3,454,320 | A | 7/1969 | Olree |
| 3,511,549 | A | 5/1970 | Maculuso |
| 3,539,236 | A | 11/1970 | Miller |
| 3,563,182 | A | 2/1971 | MacFarlane |
| 3,596,942 | A | 8/1971 | Zoebelein |
| 3,623,784 | A | 11/1971 | Neufeld |
| 3,684,220 | A | 8/1972 | Logsdon |
| 3,685,781 | A | 8/1972 | Webster |
| 3,743,106 | A | 7/1973 | Maziarka et al. |
| 3,764,190 | A | 10/1973 | Anderson |
| 3,767,280 | A | 10/1973 | McLaughlin |
| 3,774,985 | A | 11/1973 | Chovanec et al. |
| 3,779,623 | A | 12/1973 | Motohashi |
| 3,799,638 | A | 3/1974 | Faiks |
| 3,853,367 | A | 12/1974 | Jamison et al. |
| 3,865,336 | A | 2/1975 | Robertson |
| 3,866,993 | A | 2/1975 | Dean et al. |
| 3,891,091 | A | 6/1975 | Anderson |
| 3,900,236 | A | 8/1975 | Goulish et al. |
| 3,909,090 | A | 9/1975 | Breckner et al. |
| 3,918,667 | A | 11/1975 | Madden |
| 3,936,108 | A | 2/1976 | Chitester |
| 3,941,441 | A | 3/1976 | Scheerhorn |
| 3,976,343 | A | 8/1976 | Breckner et al. |
| 3,979,093 | A | 9/1976 | Madden |
| 3,984,163 | A | 10/1976 | Boorman, Jr. et al. |
| 4,092,056 | A | 5/1978 | Signore et al. |
| 4,168,103 | A | 9/1979 | Hagen |
| 4,184,660 | A | 1/1980 | Anderson |
| 4,192,477 | A | 3/1980 | Decky et al. |
| 4,201,428 | A | 5/1980 | Johnson |
| 4,228,980 | A | 10/1980 | Beauchamp et al. |
| 4,240,685 | A | 12/1980 | Terlecki |
| 4,246,769 | A | 1/1981 | McLaughlin |
| 4,265,500 | A | 5/1981 | Berton et al. |
| 4,298,236 | A | 11/1981 | Laroche |
| 4,303,287 | A | 12/1981 | Taplin |
| 4,355,851 | A | 10/1982 | Slusser |
| 4,425,013 | A | 1/1984 | Killen |
| 4,429,930 | A | 2/1984 | Blouin |
| 4,480,883 | A | 11/1984 | Young |
| 4,482,066 | A | 11/1984 | Dykstra |
| 4,535,196 | A | 8/1985 | Milne |
| 4,609,233 | A | 9/1986 | Walla |
| 4,616,890 | A | 10/1986 | Romick |
| 4,653,820 | A | 3/1987 | Tazaki |
| 4,662,689 | A | 5/1987 | Chatterson et al. |
| 4,662,776 | A | 5/1987 | Hedstrom et al. |
| 4,692,984 | A | 9/1987 | McKernan et al. |
| 4,707,038 | A | 11/1987 | Voegeli |
| 4,711,505 | A | 12/1987 | Lakso |
| 4,712,844 | A | 12/1987 | Fry |
| 4,761,045 | A | 8/1988 | Paine |
| 4,768,844 | A | 9/1988 | Ludwig |
| 4,838,624 | A | 6/1989 | Walla |
| 4,838,627 | A | 6/1989 | Macias |
| 4,859,008 | A | 8/1989 | Eyre et al. |
| 4,889,396 | A | 12/1989 | Mitchell et al. |
| 4,925,257 | A | 5/1990 | Frederiksen et al. |
| 4,925,258 | A | 5/1990 | Ludwig et al. |
| 4,930,733 | A | 6/1990 | Logsdon |
| 4,936,640 | A | 6/1990 | Pratzer |
| 4,957,334 | A | 9/1990 | Lakso |
| 4,960,309 | A | 10/1990 | Scheerhorn |
| 4,966,422 | A | 10/1990 | Albright et al. |
| 4,966,423 | A | 10/1990 | Higuera et al. |
| 5,040,858 | A | 8/1991 | Kruse et al. |
| 5,050,942 | A | 9/1991 | Frederick et al. |
| 5,056,876 | A | 10/1991 | Scheerhorn |
| 5,056,877 | A | 10/1991 | Westwinkel |
| 5,062,678 | A | 11/1991 | Westwinkel |
| 5,074,627 | A | 12/1991 | Broeders |
| 5,102,210 | A | 4/1992 | Beals |
| D326,603 | S | 6/1992 | Rogers |
| 5,176,436 | A | 1/1993 | Mitchell |
| 5,184,887 | A | 2/1993 | O'Keefe et al. |
| 5,199,774 | A | 4/1993 | Hedinger et al. |
| 5,209,572 | A | 5/1993 | Jordan |
| 5,225,825 | A | 7/1993 | Warren |
| 5,246,286 | A | 9/1993 | Huebschen et al. |
| 5,303,994 | A | 4/1994 | Elsholz |
| 5,335,986 | A | 8/1994 | Hartrum et al. |
| 5,352,030 | A | 10/1994 | Derle et al. |
| 5,358,322 | A | 10/1994 | McLaughlin |
| 5,364,178 | A | 11/1994 | Hofman et al. |
| 5,372,262 | A | 12/1994 | Benson et al. |
| 5,378,057 | A | 1/1995 | Bach et al. |
| 5,427,445 | A | 6/1995 | Mitchell |
| 5,433,516 | A | 7/1995 | Beals et al. |
| 5,449,231 | A | 9/1995 | Lin |
| 5,472,270 | A | 12/1995 | Czarnecky et al. |
| 5,496,105 | A | 3/1996 | Czarnecky et al. |
| 5,533,798 | A | 7/1996 | Feldpausch et al. |
| 5,562,332 | A | 10/1996 | Stacy |
| 5,565,251 | A | 10/1996 | Tang et al. |
| 5,567,027 | A | 10/1996 | McClung et al. |
| 5,580,137 | A | 12/1996 | Doan et al. |
| 5,599,078 | A | 2/1997 | Dechene et al. |
| 5,632,542 | A | 5/1997 | Krivec |

| | | | |
|---|---|---|---|
| 5,702,167 | A | 12/1997 | Muller |
| 5,709,442 | A | 1/1998 | Feldpausch et al. |
| 5,775,786 | A | 7/1998 | Liebertz |
| 5,785,401 | A | 7/1998 | Bowyer et al. |
| 5,820,234 | A | 10/1998 | Capwell et al. |
| 5,823,643 | A | 10/1998 | Feldpausch et al. |
| 5,853,237 | A | 12/1998 | Powell et al. |
| 5,927,838 | A | 7/1999 | Hellman, Jr. |
| 5,927,839 | A | 7/1999 | Alfaro |
| 5,931,548 | A | 8/1999 | Bischoff |
| 5,946,953 | A | 9/1999 | Feldpausch |
| 5,997,114 | A | 12/1999 | Bischoff |
| 6,007,170 | A | 12/1999 | Liebertz et al. |
| D423,917 | S | 5/2000 | Remmers et al. |
| 6,076,908 | A | 6/2000 | Maffeo |
| 6,123,402 | A | 9/2000 | Bowyer et al. |
| 6,199,967 | B1 | 3/2001 | Bayles et al. |
| 6,209,976 | B1 | 4/2001 | Shear |
| 6,217,139 | B1 | 4/2001 | Henriott et al. |
| 6,231,141 | B1 | 5/2001 | Liebertz et al. |
| 6,240,801 | B1 | 6/2001 | Kojima et al. |
| 6,254,205 | B1 | 7/2001 | Wright et al. |
| 6,378,967 | B1 | 4/2002 | Moser et al. |
| 6,416,145 | B1 | 7/2002 | Singh |
| 6,422,399 | B1 | 7/2002 | Castillo et al. |
| 6,497,462 | B2 | 12/2002 | Jackson |
| 6,568,771 | B2 | 5/2003 | Gentili et al. |
| 6,585,203 | B1 | 7/2003 | Euker |
| 6,598,835 | B2 | 7/2003 | Minnick |
| 6,601,884 | B2 | 8/2003 | Bastian |
| 6,601,933 | B1 | 8/2003 | Greenwald |
| 6,619,772 | B2 | 9/2003 | Dierbeck |
| 6,626,300 | B2 | 9/2003 | Kaminski et al. |
| 6,637,843 | B2 | 10/2003 | Westwinkel |
| 6,698,258 | B2 | 3/2004 | Westwinkel |
| 6,736,468 | B1 | 5/2004 | Wilson |
| 6,749,274 | B2 | 6/2004 | Westwinkel |
| 6,765,147 | B1 | 7/2004 | Rix |
| 6,779,855 | B2 | 8/2004 | Hoffman |
| 6,877,831 | B2 | 4/2005 | Timmerman et al. |
| 2001/0050518 | A1 | 12/2001 | Liebertz et al. |
| 2002/0148796 | A1 | 10/2002 | Lin |
| 2002/0185943 | A1 | 12/2002 | Gentili et al. |
| 2003/0062810 | A1 | 4/2003 | Westwinkel |
| 2003/0111941 | A1 | 6/2003 | Noel et al. |
| 2003/0173878 | A1 | 9/2003 | Youngs et al. |
| 2004/0036387 | A1 | 2/2004 | Ludwig et al. |
| 2004/0100165 | A1 | 5/2004 | Hoffman |
| 2004/0100166 | A1 | 5/2004 | Hoffman |
| 2004/0119385 | A1 | 6/2004 | Timmerman et al. |
| 2004/0119389 | A1 | 6/2004 | Timmerman et al. |
| 2004/0207135 | A1 | 10/2004 | Joseph |
| 2004/0256527 | A1 | 12/2004 | James et al. |
| 2005/0023941 | A1 | 2/2005 | Chiu |
| 2006/0267461 | A1* | 11/2006 | Hoffman ..... 312/219 |
| 2008/0106175 | A1* | 5/2008 | Huang ..... 312/217 |

FOREIGN PATENT DOCUMENTS

| | | | |
|---|---|---|---|
| JP | 10205191 | A * | 8/1998 |

* cited by examiner

STORAGE CABINET ASSEMBLY

BACKGROUND OF THE INVENTION

The present invention relates to a storage cabinet assembly, and in particular to a storage cabinet assembly including an inventive base assembly for supporting an associated housing, as well as a drop-in drawer arrangement, and an inventive drawer interlock assembly preventing multiple drawers from being simultaneously moved to an opened position.

Storage cabinet assemblies are used in a wide variety of office-type applications, and are provided in a multitude of configurations for storing files, literature, clothing, and the like therein. These storage cabinet assemblies typically include a housing and a plurality of drawers or doors allowing access to an interior space therein. In some applications, these cabinets are required to support a significant load therein, thereby requiring significant structural reinforcement to any supporting base. Further, those storage cabinet assemblies that include a plurality of drawers often include complicated, relatively expensive and relatively difficult to assemble supporting assemblies that allow the drawers to be slidably removed from within the interior space of the housing. Moreover, these cabinets typically include drawer interlock arrangements of relatively complicated design that are adapted to prevent multiple drawers from being simultaneously opened from within the cabinet. These and other current design characteristics result in storage assemblies that are complicated in design, costly to manufacture, difficult to assemble and prone to failure during use.

The present inventive storage cabinet assembly provides a relatively low cost, easy-to-assemble base assembly for supporting an associated housing thereon, that simultaneously provides adequate support for significantly heavy loads. The storage cabinet assembly further provides a drop-in drawer arrangement allowing quick assembly of the drawers with the drawer supporting structure of the storage cabinet assembly by unskilled personnel without the use of specialized tools. Still further, the storage cabinet assembly includes a drawer interlock assembly that prevents the misalignment of associated components within the interlock assembly while associated drawers are moved between opened and closed positions.

SUMMARY OF THE INVENTION

In one aspect of the present invention, a storage cabinet assembly that comprises a housing including a pair of sidewalls, a rear wall, and a top wall that cooperates with the sidewalls and the rear wall to form a storage area. The storage cabinet assembly further comprises a base assembly supporting the housing that includes a top wall having a plurality of side edges that cooperate to form a plurality of corners therebetween, a bottom wall having a plurality of side edges that cooperate to form a plurality of corners substantially co-aligned with the corners of the top wall, wherein the bottom wall is spaced from the top wall thereby defining a gap therebetween, and at least one corner support bracket located within the gap substantially proximate one of the corners of the top wall and the bottom wall and extending between the top wall and the bottom wall. The corner support bracket extends angularly with respect to the side edges of the top wall and the bottom wall cooperating to form the corner proximate the location of the corner support bracket.

In another aspect of the present invention, a storage cabinet assembly that comprises a housing including a plurality of sidewalls, a rear wall, a bottom wall, and a top wall that cooperates with the sidewalls, the rear wall and the bottom wall to form a storage area. The storage cabinet assembly also comprises a pair of drawer slide assemblies operably disposed within the storage area of the housing and each including a first rail member operably coupled to one of the sidewalls of the housing, and a second rail member telescopingly coupled to the first rail member and having an inner surface and an irregularity spaced along the length of the inner surface and extending inwardly therefrom. The storage cabinet assembly further comprises a drawer assembly operably disposed within the storage area of the housing and including a bottom wall having a pair of notches, a rear wall and a pair of sidewalls cooperating with the bottom wall and the rear wall of the drawer assembly to form an interior space. Each of the sidewalls of the drawer assembly include a downwardly-extending tab member disposed within a notch aligned with one of the notches of the bottom wall of the drawer assembly, wherein the irregularity of each of the second rail members engage a tab of the drawer assembly therein and is substantially vertically aligned with one of the notches of the bottom wall of the drawer assembly.

In yet another aspect of the present invention, a method for assembling a storage cabinet assembly comprises providing a housing including a pair of sidewalls, a rear wall, a bottom wall, and a top wall that cooperate to form a storage area, and providing a pair of drawer slide assemblies each including a first rail member operably coupled to one of the sidewalls of the housing, and a second rail member telescopingly coupled to the first rail member and including an inner surface and an irregularity spaced along a length of the inner surface and extending inwardly therefrom. The method also includes providing a drawer and including a bottom wall having a pair of notches, a rear wall, and a pair of sidewalls cooperating with the bottom wall and the rear wall of the drawer assembly to form an interior space, wherein each of the sidewalls includes a downwardly-extending tab member disposed within a notch aligned with one of the notches of the bottom wall of the drawer. The method further includes coupling the drawer with the drawer slide assemblies by aligning the notches of the bottom wall of the drawer with the irregularities of the second rail members and moving the drawer towards the drawer slide assemblies such that the irregularities of the second rail members pass through the notches of the bottom wall of the drawer and engage the tabs of the sidewalls of the drawer, thereby operably supporting the drawer within the storage area.

Still yet another aspect of the present invention is to provide a storage cabinet assembly that comprises a housing including a pair of sidewalls, a rear wall, a bottom wall, and a top wall that cooperates with the sidewalls, the rear wall and the bottom wall to form a storage area. The storage cabinet assembly also includes at least two drawers operably disposed within the housing between an open position, wherein at least a portion of the drawer extends outwardly from within the storage area, and a closed position, wherein the drawer is retracted into the storage area, and wherein each drawer includes an actuator member. The storage cabinet assembly further comprises a drawer interlock for preventing the simultaneous opening of two drawers including a cam operably connected to the housing adjacent each drawer, wherein each cam includes at least a first cam arm extending therefrom into a path followed by the actuator member on the drawer when the drawer is moved from the closed position to the open position, each cam moving from a first position to a second position when the drawer is moved from the closed position to the open position, each actuator member disengaging the cam as the cam reaches the second position, whereby the drawer is free to pass by the cam and moved to the open position, and wherein each cam includes a first stop member extending therefrom. The drawer interlock also includes a stop member operably coupled to the housing adjacent each drawer and fixed for rotation with respect to the cam, wherein the first member abuts the second stop member when the cam reaches the second position, thereby preventing over rotation of the cam and a first direction of rotation. The drawer interlock further includes a flexible stop element of fixed length coupled with the housing adjacent all of the cams, wherein the stop element is movable between first and second positions when engaged by any one of the cam members without effecting movement of the other cam members, and wherein each of the cams not in the second position thereof are blocked from movement from the first position to the second position thereof when the stop element is in the second position thereof.

In yet another aspect of the present invention, a drawer interlock assembly prevents simultaneous opening of multiple drawers of the storage cabinet assembly from within a storage area defined by a housing of the storage cabinet assembly, wherein the drawer includes an actuator and is operably disposed within the storage area between an open position, wherein at least a portion of the drawer extends outwardly from within the storage area, and a closed position, wherein the drawer is retracted into the storage area. The drawer interlock assembly comprises a cam connectable to the housing adjacent each of a multiple of drawers, wherein each cam includes at least a first cam arm adapted to extend into a path followed by an actuator member on a drawer when a drawer is moved from a closed position to an open position, each cam is adapted to move from a first position to a second position when a drawer is moved from a closed position to an open position, each cam is adapted to disengage an actuator member as the cam reaches the second position whereby a drawer is free to pass by the cam and moved to an open position, and wherein each cam includes a first stop member extending therefrom. The drawer interlock assembly also comprises a second stop member connectable to a housing adjacent a drawer and fixed for rotation with respect to the cam, wherein the first stop member abuts the second stop member when the cam reaches the second position, thereby preventing over-rotation of the cam in a first direction of rotation. The drawer interlock assembly further comprises a flexible stop element of fixed length connectable with a housing adjacent all of the cams, wherein the stop element is movable between first and second positions when engaged by any one of the cam members without effecting movement of the other cam members, and wherein each of the cams not in the second position thereof are blocked from movement from the first position to the second position thereof when the stop element is in the second position thereof.

In another aspect of the present invention, a storage cabinet assembly comprises a housing including a pair of sidewalls, a rear wall, a bottom wall, and a top wall that cooperates with the sidewalls, the rear wall and the bottom wall to form a storage area, and a pair of uprights fixedly secured to the sidewalls disposed across the housing from one another. The storage cabinet assembly also comprises a pair of drawer slide assemblies each including a first rail member operably coupled to one of the uprights, and a second rail member telescopingly coupled to the first rail member, and at least two drawers operably coupled to the second rail member of each drawer slide assembly and movable between an open position, wherein at least a portion of the drawer extends outwardly from within the storage area, and a closed position wherein the drawer is retracted into the storage area, and wherein each drawer includes an actuator member. The storage cabinet assembly further comprises a drawer interlock assembly for preventing the simultaneous opening of two drawers, wherein the drawer interlock includes a mounting member operably coupled to the upright adjacent each drawer, a cam pivotally coupled to the mounting member adjacent each drawer, each cam moving from a first position to a second position when the drawer is moved from the closed position to the open position, and from the first position to the second position when the drawer is moved from the open position to the closed position, each cam is operably coupled with the other cams such that the movement of one cam from the first position to the second position prevents movement of the other cams from the first position to the second position, and wherein at least a portion of the mounting member is positioned between one of the slide assemblies and one of the uprights.

The present inventive storage cabinet assembly provides a relatively low cost, easy-to-assemble base assembly for supporting an associated housing thereon, that simultaneously provides adequate support for significantly heavy loads. The storage cabinet assembly further provides a drop-in drawer arrangement allowing quick assembly of the drawers with the drawer supporting structure of the storage cabinet assembly by unskilled personnel without the use of specialized tools. Still further, the storage cabinet assembly includes a drawer interlock assembly that prevents the misalignment of associated components within the interlock assembly while associated drawers are moved between opened and closed positions.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
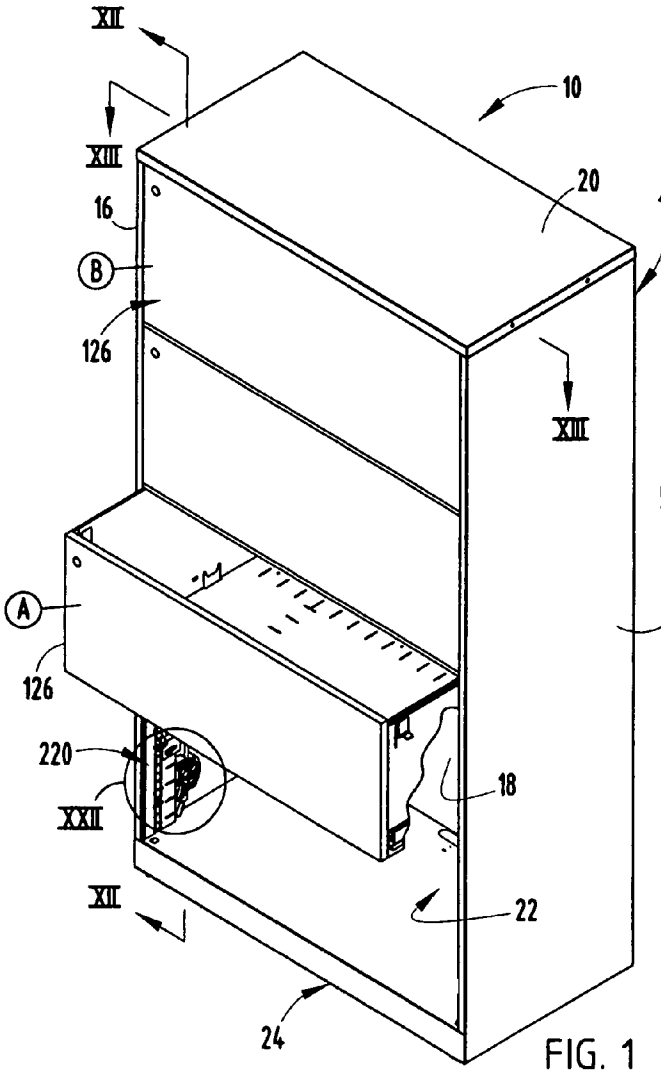
FIG. 1 is a perspective view of a storage cabinet assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
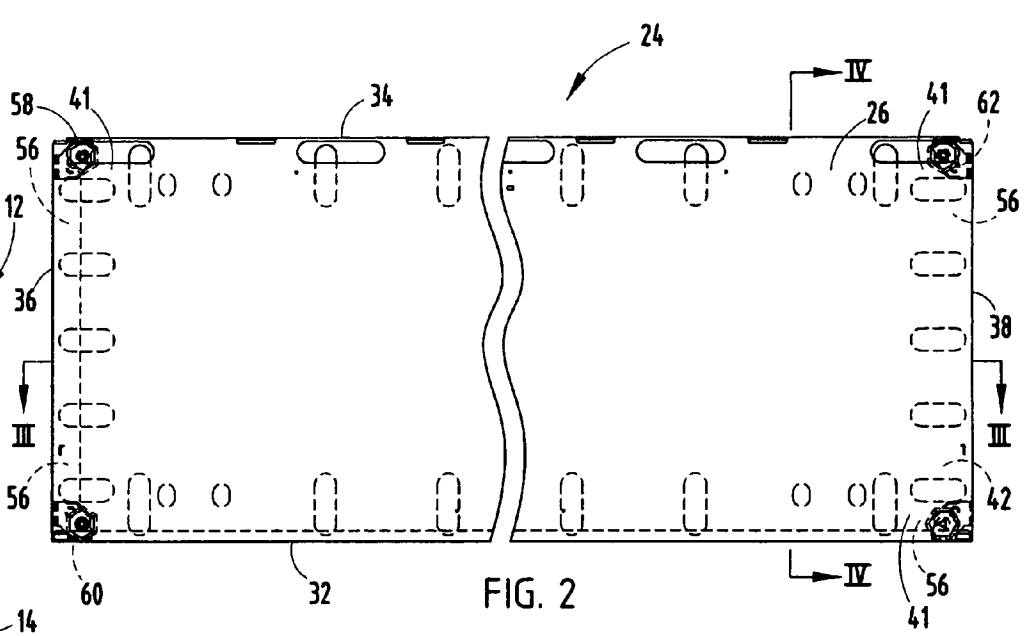
FIG. 2 is a top plan view of a base assembly.
Figure 3:
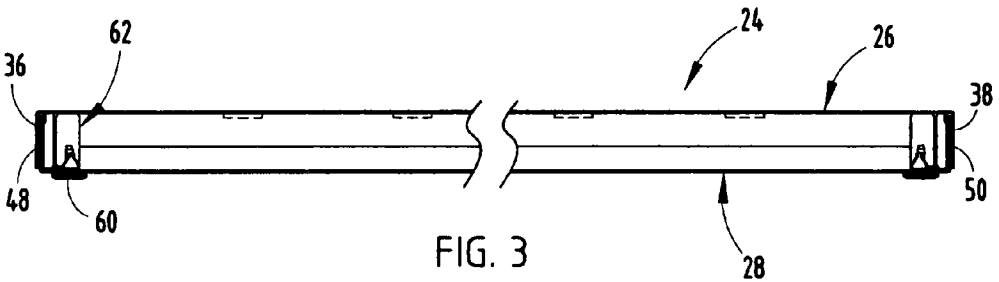
FIG. 3 is a front cross-sectional view of the base assembly taken along the line III-III, FIG. 2.
Figure 4:
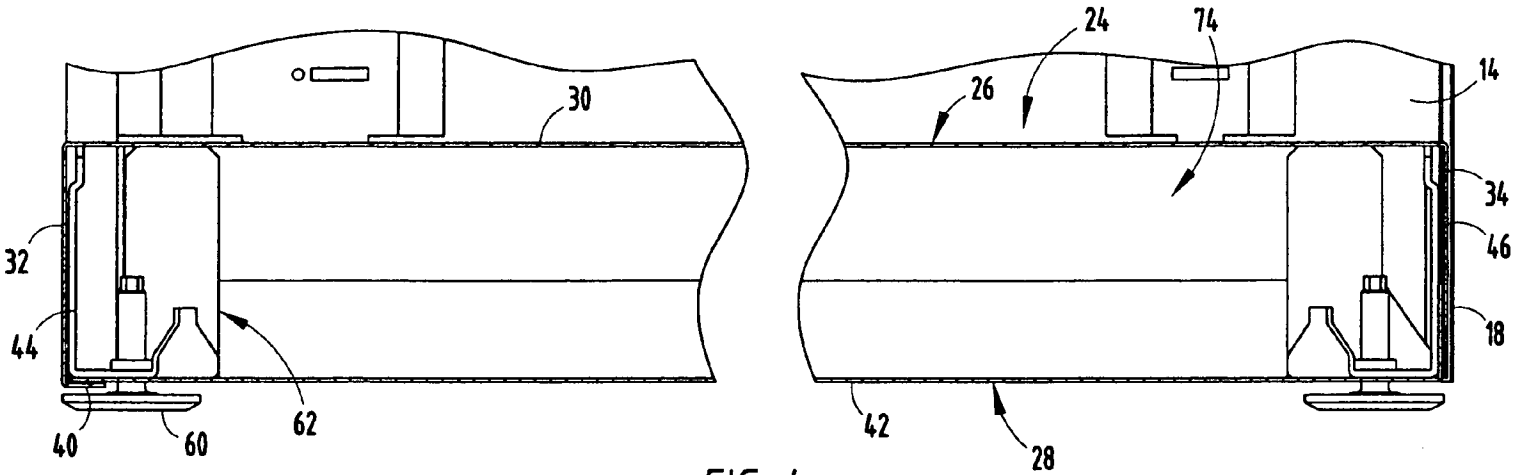
FIG. 4 is a side cross-sectional view of the base assembly taken along the line IV-IV, FIG. 2.

The reference numeral 10 (FIG. 1) generally designates a storage cabinet assembly embodying the present invention. In the illustrated example, the storage cabinet assembly 10 comprises a housing 12 that includes a pair of sidewalls 14, 16, a rear wall 18, and a top wall 20 that cooperate to form an interior storage area 22. The sidewalls 14, 16 and the rear wall 18 are preferably secured to one another via a plurality of spot welds, however, other forms of fastening may be employed The top wall 20 is secured to the sidewalls 14, 16 and the rear wall 18 by a plurality of mechanical fasteners (not shown), however, this may again be secured to the other walls by other means as known in the art. The storage cabinet assembly 10 also includes a base assembly 24 (FIGS. 2-4) that supports the housing 12. The base assembly 24 includes an upper pan member 26 that mates with a lower pan member 28. The upper pan member 26 includes a top wall 30, a front wall 32, a rear wall 34 and sidewalls 36, 38. The front wall 32, the rear wall 34 and the sidewalls 36, 38 are integrally formed with the top wall 30 and extend orthogonally downward therefrom. A lip 40 extends orthogonally inward from and is integrally formed with the front wall 32. The front 32, the rear wall 34 and the sidewalls 36, 38 serve to define a plurality of edges of the top wall 30, which in turn define a plurality of corners 41. The lower pan member 28 includes a bottom wall 42, a front wall 44, a rear wall 46 and a pair of sidewalls 48, 50. The front wall 44, the rear wall 46 and the sidewalls 48, 50 cooperate with the bottom wall 42 to define a plurality of corners 56. The lower pan member 28 further includes a plurality of apertures 58 located proximate the corners 56 for receiving support legs 60 therein.

Figure 5:
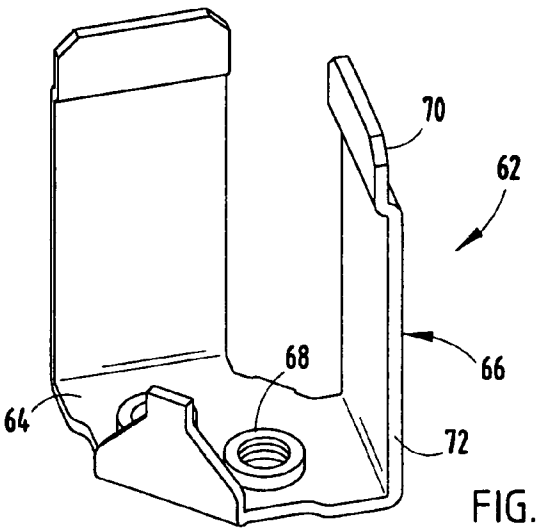
FIG. 5 is a perspective view of a corner support bracket.

The base assembly 24 further includes a plurality of corner supports or corner support brackets 62 located substantially proximate the corners 41, 56. Specifically, each corner support bracket 62 (FIG. 5) includes a base portion 64 and a pair of structural support legs 66 extending orthogonally upward from the base portion 64. The base portion 64 includes a pair of threaded apertures 68. Each support leg 66 includes a proximal end 70 inwardly offset from an associated body portion 72, thereby adding structural rigidity to each of the support legs 66.

In the assembly, each corner support bracket 62 is placed in a corresponding corner 56 of the lower pan member 28 such that the body portion 72 of one of the support legs 66 of each corner support bracket 62 abuts either the front wall 44 or the rear wall 46 of the lower pan member 28, while the remaining support legs 66 of each corner support bracket 62 abuts one of the sidewalls 48, 50, thereby properly locating each corner support bracket 62 with respect to the lower pan member 28. Each corner support bracket 62 is secured to the lower pan member 28 by mechanical fasteners such as screws (not shown) that are received within apertures located in the bottom wall 42 of the lower pan member 28 and that are threadably received within the threaded apertures 68 of the base portion 64 of each of the corner support brackets 62. Alternatively, the corner support brackets 62 may be weldably secured to the lower pan 28. The upper pan member 26 and the lower pan member 28 are then mated together such that the front wall 32, the rear wall 34 and the sidewalls 36, 38 of the upper pan 26 abut the front wall 44, the rear wall 46 and the sidewalls 48, 50 of the lower pan member 28, respectively. The upper pan member 26 and the lower pan member 28 are then secured to one another by a plurality of spot welds securing the corresponding walls to one another, thereby creating the unitary base assembly 24, and defining a gap or space 74 between the top wall 30 of the upper pan member 26 and the bottom wall 42 of the lower pan member 28. The housing 12 is then secured to the base assembly 24 by placing the base assembly 24 within the housing 12 such that the sidewalls 14, 16 and the rear wall 18 of the housing 12 overlap the sidewalls 36, 38 and the rear wall 34 of the upper pan member 26, which are then secured to one another by a plurality of spot welds.

Figure 6:
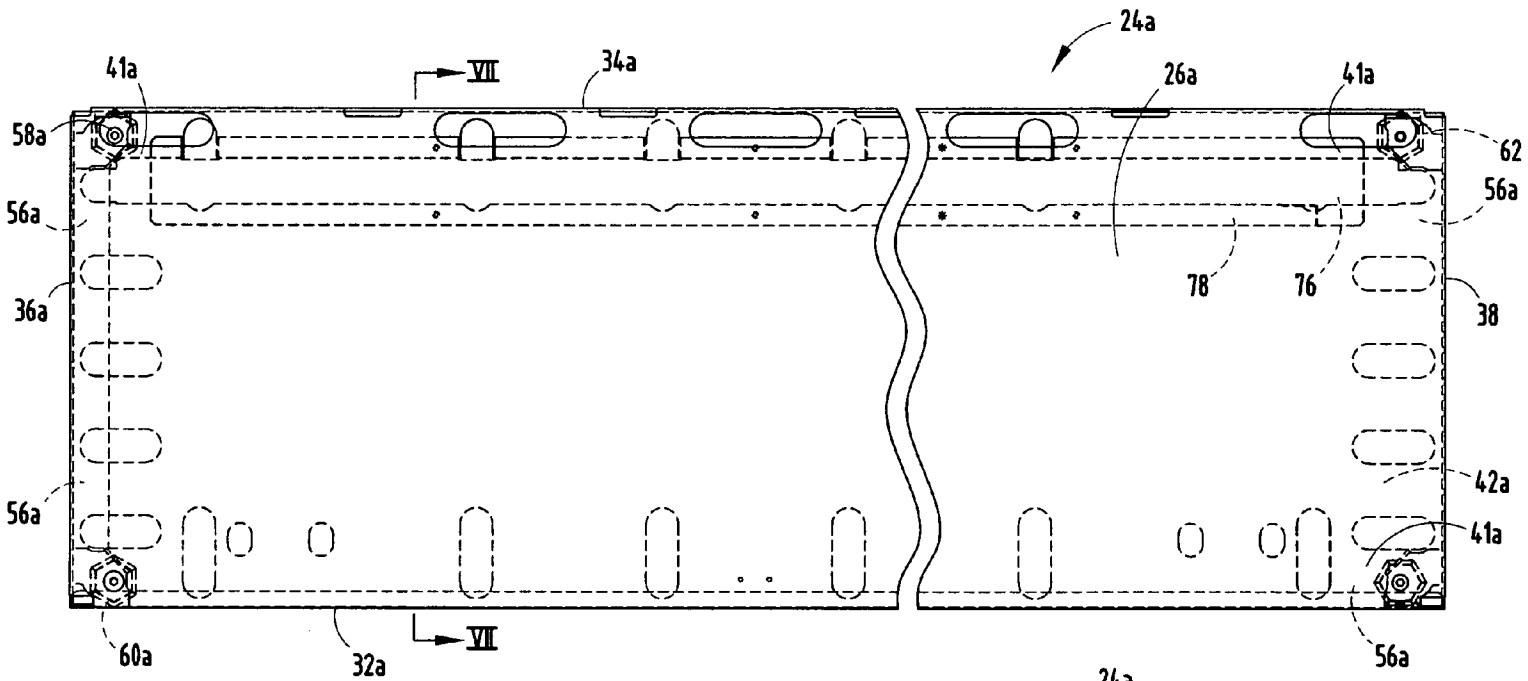
FIG. 6 is a top plan view of a first alternative embodiment of the base assembly.
Figure 7:
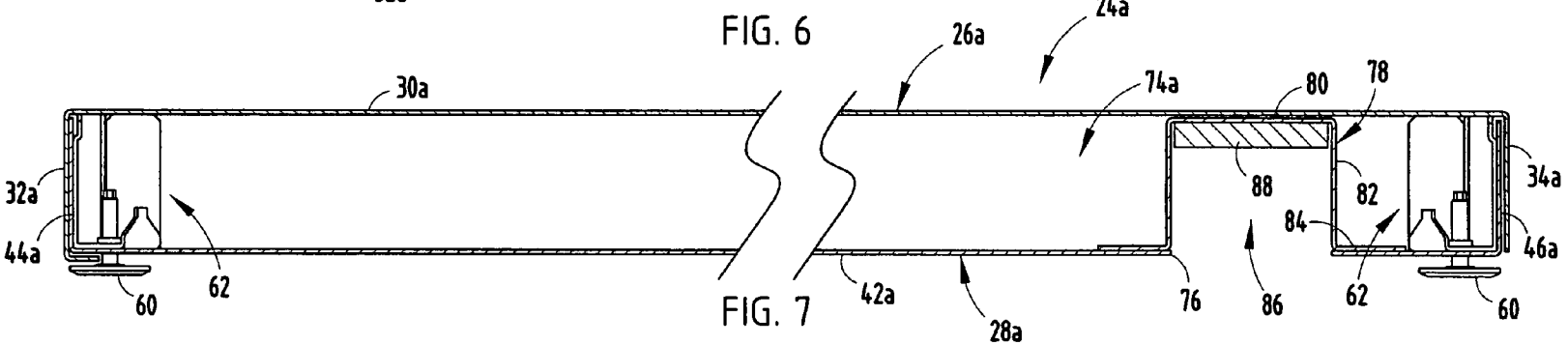
FIG. 7 is a side cross-sectional view of the first alternative embodiment of the base assembly, taken along the line VII-VII, FIG. 6.

The reference numeral **24*a* (FIGS. 6 and 7) generally designates another embodiment of the base assembly. Since the base assembly 24*a* is similar to the previously-described base assembly 24, similar parts appearing in FIGS. 2-4 and FIGS. 6 and 7, respectively, are represented by the same, corresponding reference numeral except for the suffix "a" in the numerals of the latter. The base assembly 24*a* is similar to the base assembly 24 with the main exception including an elongated aperture 76 located within the bottom wall 42*a* of the lower pan member 28*a*, and the inclusion of a hat-shaped, elongated structural support member spanning the aperture 76. The structural support member 78 includes a top wall 80, a pair of sidewalls 82 extending orthogonally from the top wall 80, and a pair of support portions 84 extending orthogonally outward from the sidewalls 82. The top wall 80 and the sidewalls 82 of the structural support member 78 cooperate to define an elongated space 86 therebetween. In assembly, the structural support member 78 is positioned such that the top wall 80 is secured to the top wall 30 of the upper pan member 26, while the support portions 84 are secured to the bottom wall 42 of the lower pan member 28. An elongated weight 88 is located and secured within the space 86 as defined within the structural support member 78. The weight member 88 counterbalances certain forces exerted on the overall storage cabinet assembly 10, such as when a drawer assembly is extended from within the housing 12, as discussed below. A plate 89 is affixed to the base assembly 24***a* across the space 86.

Figure 8:
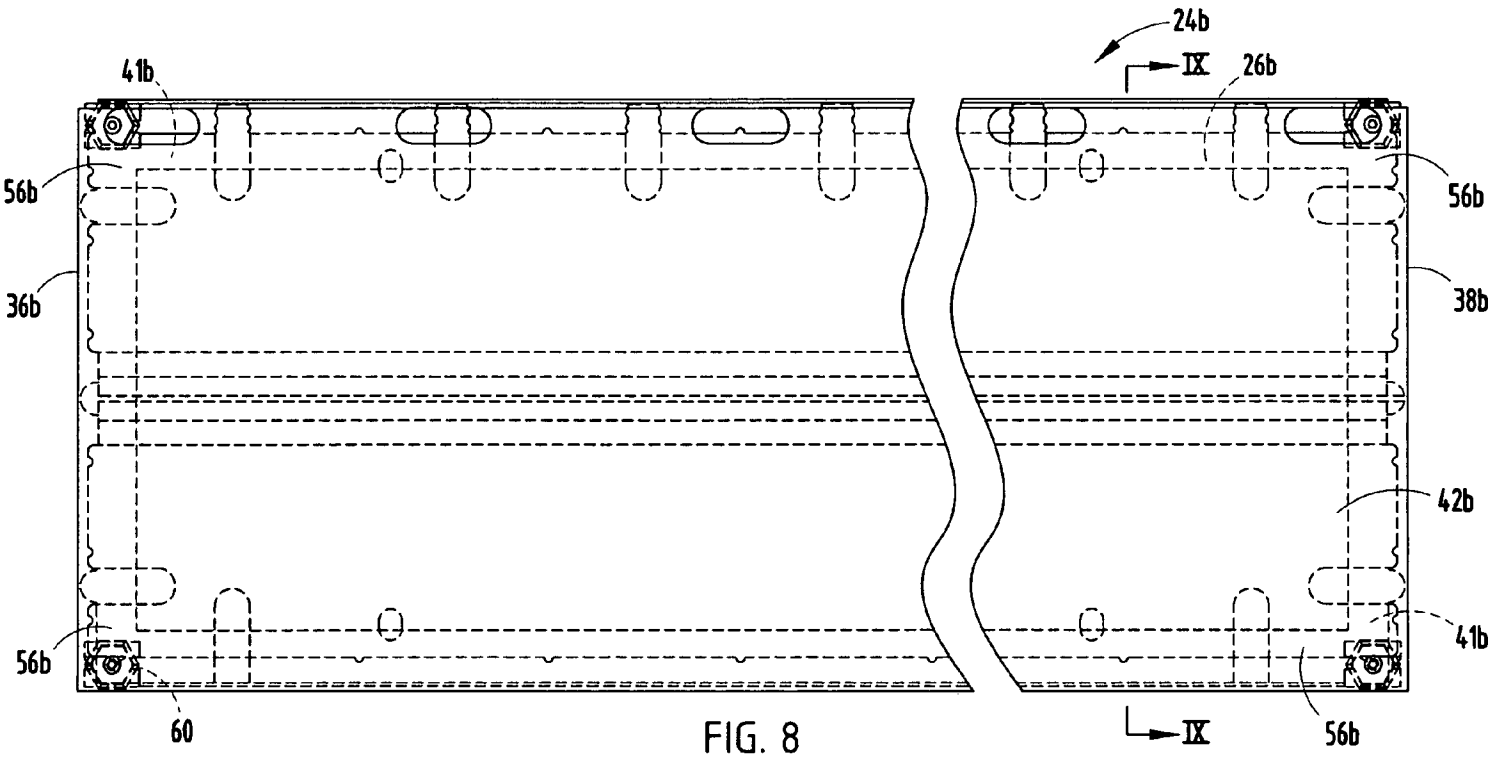
FIG. 8 is a top plan view of a second alternative embodiment of the base assembly.
Figure 9:
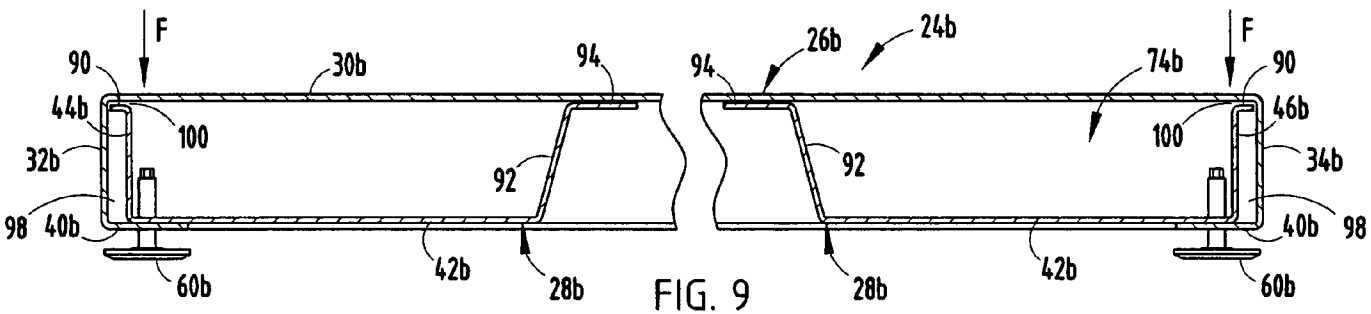
FIG. 9 is a side cross-sectional view of the second alternative embodiment of the base assembly, taken along the line IX-IX, FIG. 8.

The reference numeral 24*b* (FIGS. 8 and 9) generally designates yet another embodiment of the base assembly. Since the base assembly 24*b* is similar to the previously-described base assembly 24, similar parts pairing in FIGS. 2-4 and FIGS. 8 and 9, respectively, are represented by the same, corresponding reference numeral, except for the suffix "b" in the numerals of the latter. The base assembly 24*b* includes an upper pan member 26*b* similarly constructed to that of the upper pan member 26. Both the front wall 32*b* and the rear wall 34*b* of the upper pan member 26*b* includes an inwardly-extending lip 96. The lower pan member 28*b* is constructed of two separate pieces, each including a bottom wall 42*b*. A front wall 44*b* extends orthogonally upward from one of the bottom walls 42*b*, while a rear wall 46*b* extends orthogonally upward from the other of the bottom walls 42*b*. Both the front wall 44*b* and the rear wall 46 include an outwardly-extending support lip 90. A support portion 92 extends angularly inward from each of the bottom walls 42*b*, while a support lip 94 extends inwardly from each of the support portions 92.

In assembly, each section forming the lower pan member 28*b* is situated with respect to the upper pan member 26*b* such that each support lip 94 abuts the top wall 30*b* of the upper pan member 26*b*, the bottom walls 42*b* of the lower pan member 28*b* abuts the lips 96 of the lower pan member 26*b* and the front wall 44*b* and rear wall 46*b* of the lower pan member 28*b* are inwardly offset from the front wall 32*b* and rear wall 34*b* of the upper pan member 26*b*, respectively, thereby creating a gap 98 therebetween. While the support lips 94 are secured to the top wall 30*b*, and the lips 40*b* of the upper pan member 26*b* are secured to the bottom wall 42*b* of the lower pan member 28*b* each by a plurality of spot welds, it is noted that the support lips 90 are not fixedly secured to the top wall 30*b* of the upper pan member 26. Preferably, a slight space or gap 100 is formed between each lip 90 and the top wall 30*b* of the upper pan member 26*b* in the absence of an external force being exerted on the base assembly 24*b*. A plate member 102 is weldably secured to the bottom of the bottom wall 42*b* of the lower pan member 28*b*, thereby eliminating rack within the overall storage cabinet assembly 10. In operation, the free-floating nature of the front wall 44*b* and rear wall 46*b* of the lower pan member 28*b* with respect to the upper pan member 26*b* in conjunction with the gaps or spaces 98*a*, allow deformity of the front wall 44*b* and the rear wall 46*b* of the lower pan member 28*b* prior to deformity of the exposed front wall 32*b* and rear wall 34*b* of the upper pan member 26*b* when an extreme load or downwardly-directed force F is exerted on the top wall 30*b* of the upper pan member 26*b*, thereby preserving the aesthetic appeal of the front wall 32*b* and the rear wall 34*b*.

Figure 10:
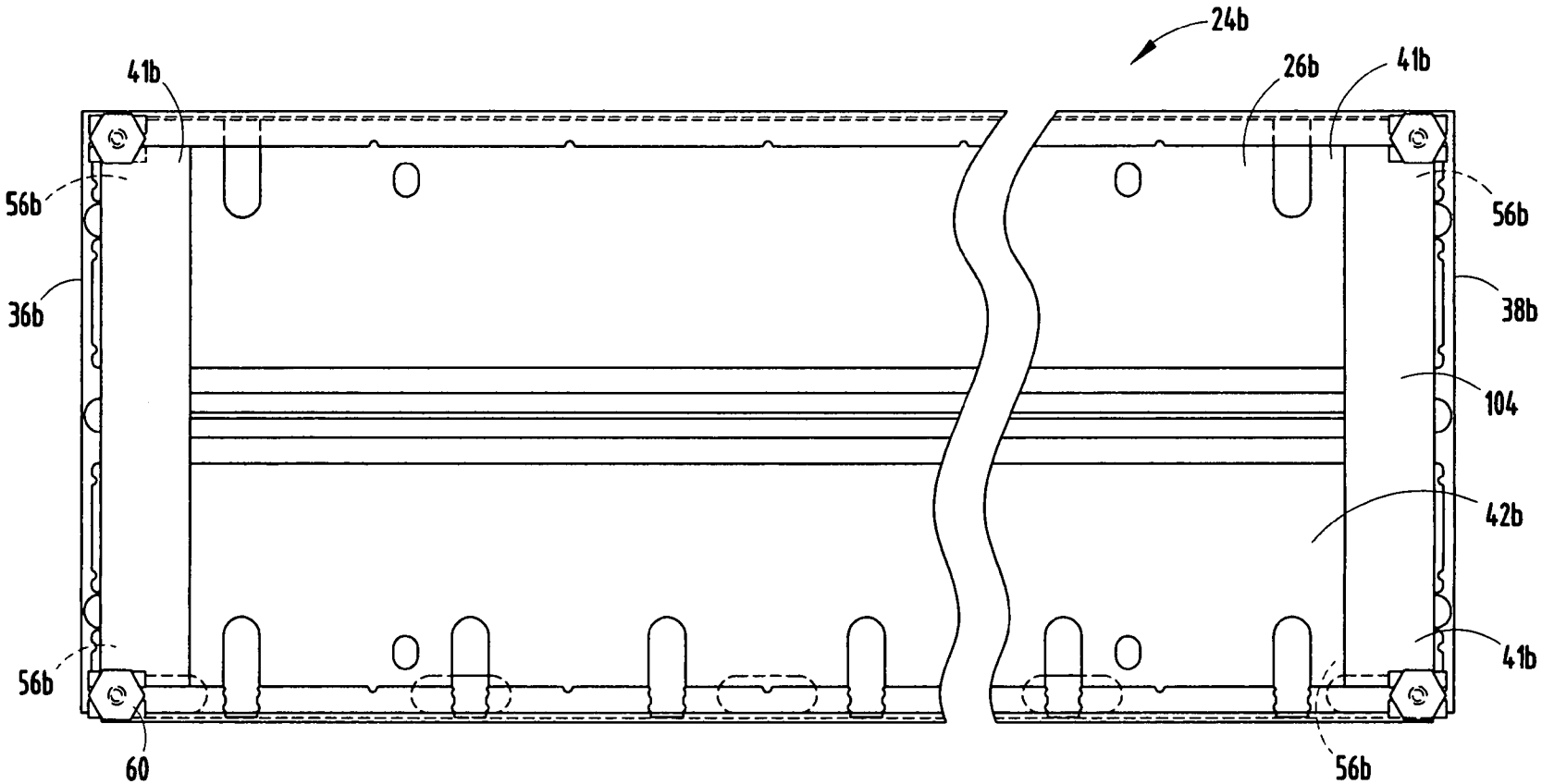
FIG. 10 a bottom plan view of a third alternative embodiment of the base assembly.
Figure 11:
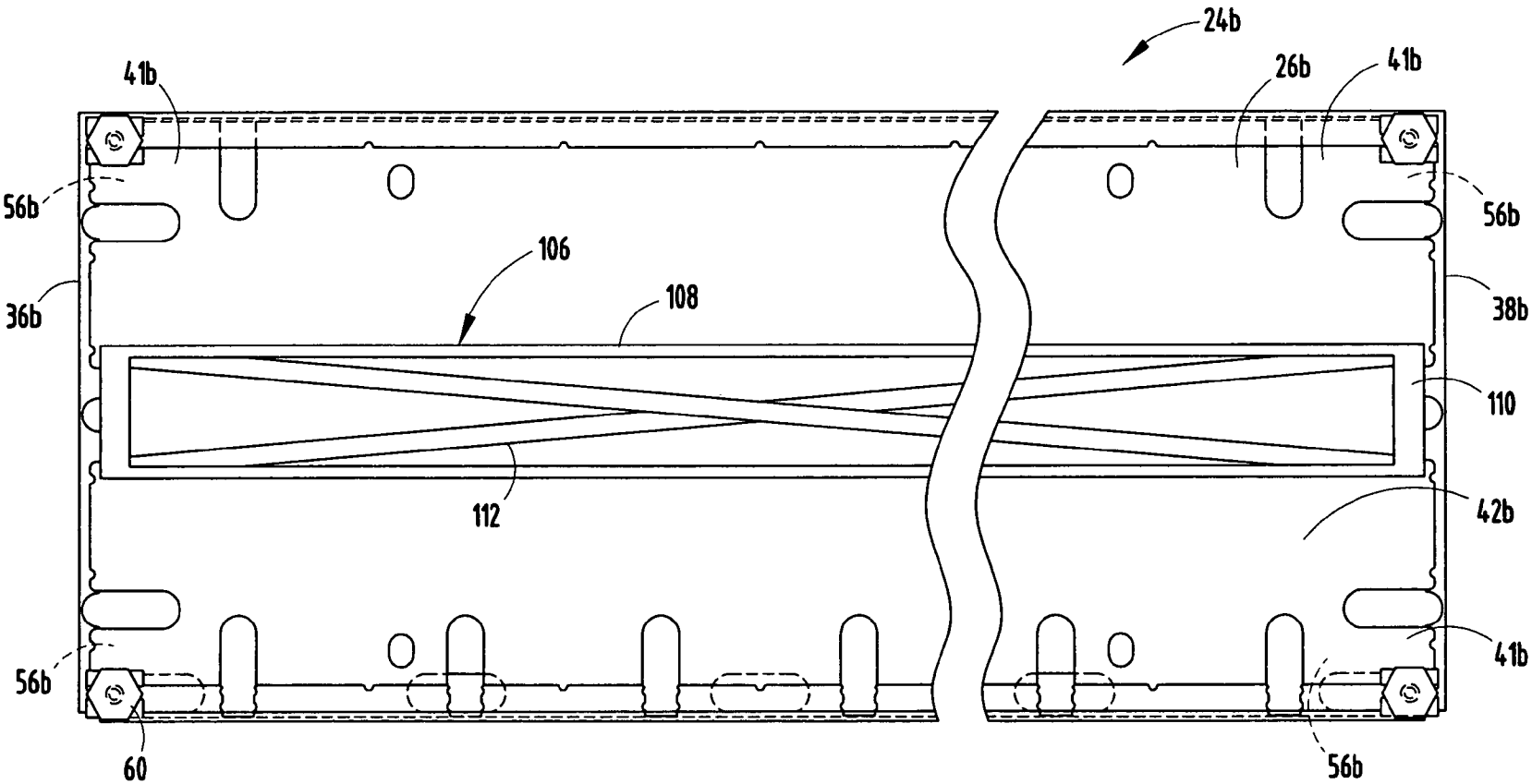
FIG. 11 a bottom plan view of a fourth alternative embodiment of the base assembly.

Alternatively, the plate member 102 is replaced by a pair of front-to-back extending reinforcement plates 104 (FIG. 10). In yet another alternative embodiment, the plate member 102 and the reinforcement plates 104 are replaced by an X-shaped reinforcement member 106 (FIG. 11). The reinforcement member 28 includes longitudinally-extending portions 108, front-to-back extending portions 110 that cooperate with the longitudinally-extending portions to form a rectangular-shape, and an X-shaped inner web 112.

Figure 13:
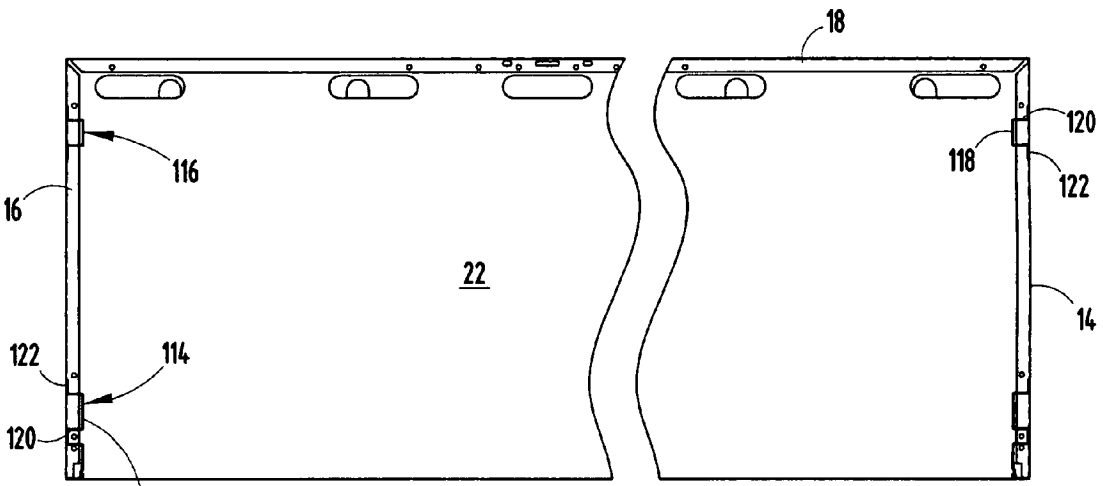
FIG. 13 is a top cross-sectional view of the storage cabinet assembly taken along the line XIII-XIII, FIG. 1.
Figure 12:
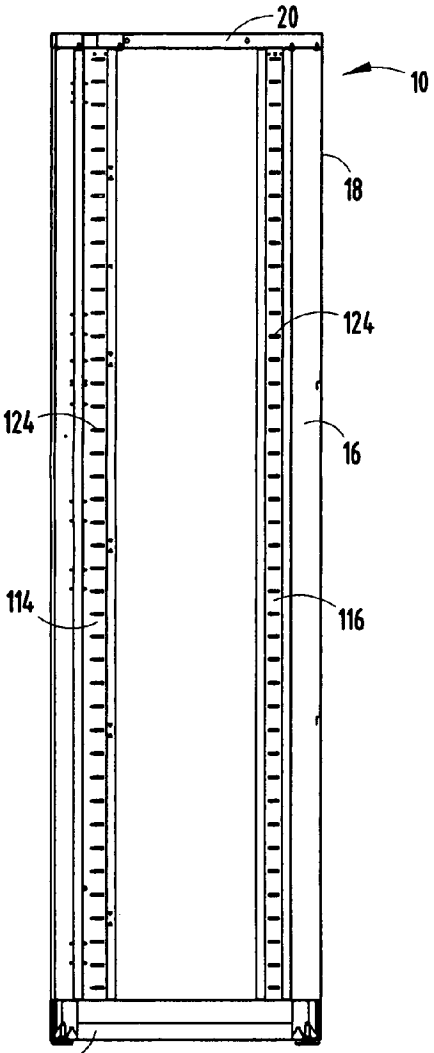
FIG. 12 a side cross-sectional view of the storage cabinet assembly including vertically-extending uprights taken along the line XII-XII, FIG. 1.

The storage cabinet assembly 10 (FIG. 12) further includes a pair of forward uprights and a pair of rearward uprights spaced rearwardly from the forward uprights 114, one of each secured to an inner surface of the sidewalls 14, 16 of the housing 12. Each of the forward uprights 114 (FIG. 13) and the rearward uprights 116 have a hat-shaped cross-sectional configuration and include an inner surface 118, a pair of side surfaces 120 extending orthogonally from the inner surface 118, and a pair of abutment portions 122 extending orthogonally from the side surfaces 120. The inner surface 118 of each of the forward uprights 114 and the rearward uprights 116 include a plurality of horizontally-extending vertically-spaced slots 124 that receive drawer support assemblies therein, as described below. The forward uprights 114 and the rearward uprights 116 extend between the top wall 20 of the housing 12 downwardly to and abutting the top wall 30 of the base assembly 24. The forward uprights 114 and the rearward uprights 116 are secured to an inner surface of the sidewalls 14, 16 by a plurality of spot welds.

The storage cabinet assembly 10 further includes a plurality of drawer assemblies 126 (FIG. 1) located within the storage area 22 of the housing 12 in a vertically-aligned manner. Each drawer assembly 126 is operable between an opened position A, wherein at least a portion of the drawer assembly 126 extends outwardly from within the storage area 22, and a closed position B, wherein the drawer assembly 126 is retracted into the storage area 22. Each drawer assembly 126 (FIG. 14) includes a bottom wall 128, a rear wall 130, a pair of sidewalls 132 and a face plate assembly 133 that cooperate to form an interior space 134. Each sidewall 132 includes an integrally-formed, inwardly-extending actuator member 136 for interaction with a drawer interlocking assembly, as described below. Each sidewall 132 (FIG. 15) also includes a pair of downwardly-extending tabs 138 disposed within and extending into apertures 140. The bottom wall 128 includes two pairs of apertures 142 co-aligned with the apertures 140, thereby allowing a drop-in type assembly of the drawer assemblies 126 within the housing 12, as described below.

Each drawer assembly 126 further includes a lock assembly 144 that includes a key-receiving lock tumbler 146 operably coupled with a cam member 148 having a cam 149 that acts on a locking rod 150 which in turns actuate a drawer stop assembly 152 between a locked and unlocked position in a manner as is known in the art. In the illustrated example, the elongated locking rod 150 includes a body portion 154, end portions 156 each including a first portion 158 extending orthogonally from the body portion 154 and a second portion 160 extending orthogonally from the associated first portion 158, and a C-shaped actuator portion 162 spaced along the length of the body portion 154.

Figure 17:
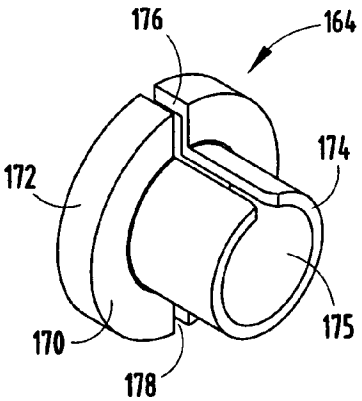
FIG. 17 is a rear perspective view of the pivot bushing.
Figure 18:
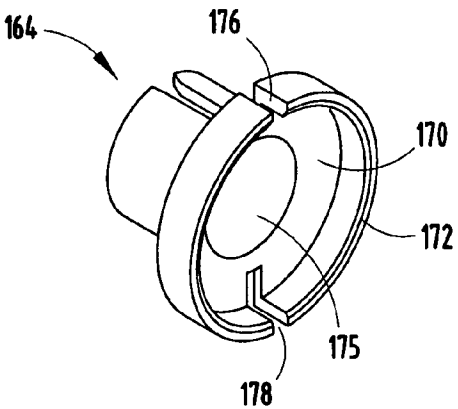
FIG. 18 is a front perspective view of the pivot bushing.
Figure 16:
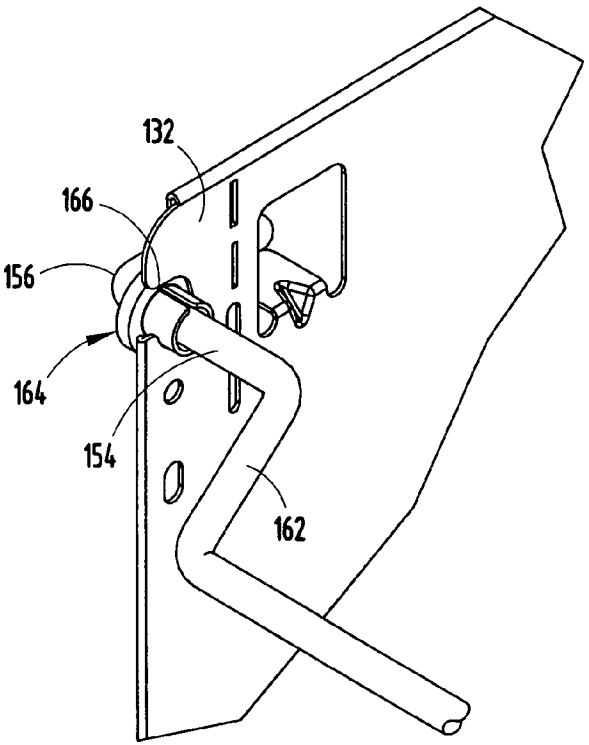
FIG. 16 is an enlarged perspective view of a bushing and a locking rod as received within the drawer assembly.

In assembly, the rod 150 is pivotally coupled with the sidewalls 132 of the associated drawer assembly 126 by placing pivot bushings 164 (FIG. 16) about the body portion 154 of the locking rod 150 proximate the end portions 156 thereof and subsequently positioning the pivot bushings 164 into forwardly-facing notches 166 located within the sidewalls 132 of the drawer assemblies 126. As illustrated, each pivot bushing 164 (FIGS. 17 and 18) includes a circularly-shaped planar body portion 170 having a skirt portion 172 extending circumferentially thereabout and orthogonally upward therefrom and a tubularly-shaped inwardly-extending collar 174 defining a bearing aperture 175. Each pivot bushing 164 further includes a longitudinally-extending first slot 176 that divides the body portion 170, the skirt portion 172 and the collar 174. Each pivot bushing 164 further includes a second slot 178 dividing the body portion 170 and the skirt portion 172 and located across the pivot bushing 164 opposite the first slot 176. Each pivot bushing 164 is comprised of a flexibly-resilient material, such as a plastic. In assembly, each pivot bushing 164 is assembled with the locking rod 150 by moving the locking rod 150 through the first slot 176 and into the bearing aperture 175, thereby forcing the pivot bushing 164 to flex about the locking rod 150. It is noted that the second slot 178 acts as a relief so as to allow proper bending and distortion of the associated pivot bushing 164 as it is assembled with the locking rod 150 and prevents catastrophic distortion of the same. The locking rod 150 and the associated pivot bushings 164 are then pivotally coupled with the sidewalls 132 of the drawer assembly 126 by placing the pivot bushings 164 into the notches 166 of the sidewalls 132.

In operation, the lock tumbler 146 rotatably actuates the cam member 148 such that the cam 149 impinges on the actuator portion 162 of the locking rod 150, thereby rotating the locking rod 150 in a first direction of rotation corresponding to and represented by directional arrow 180. The force as exerted by the cam 149 onto the locking rod 150 overcomes a spring-biasing force exerted on the locking rod 150 by a coil-spring 182. The coil spring 182 includes a first end coupled with the actuator portion 162 of the locking rod 150 and a second end received within an aperture 184 of the header bar 186. The header bar 186 includes ends 188 received within slots 190 located within the sidewalls 132 of the drawer assembly 126. The force as exerted on the locking rod 150 by the coil spring 182 forces the locking rod 150 in a direction as indicated and represented by directional arrow 192 and opposite to direction 180.

Figure 19:
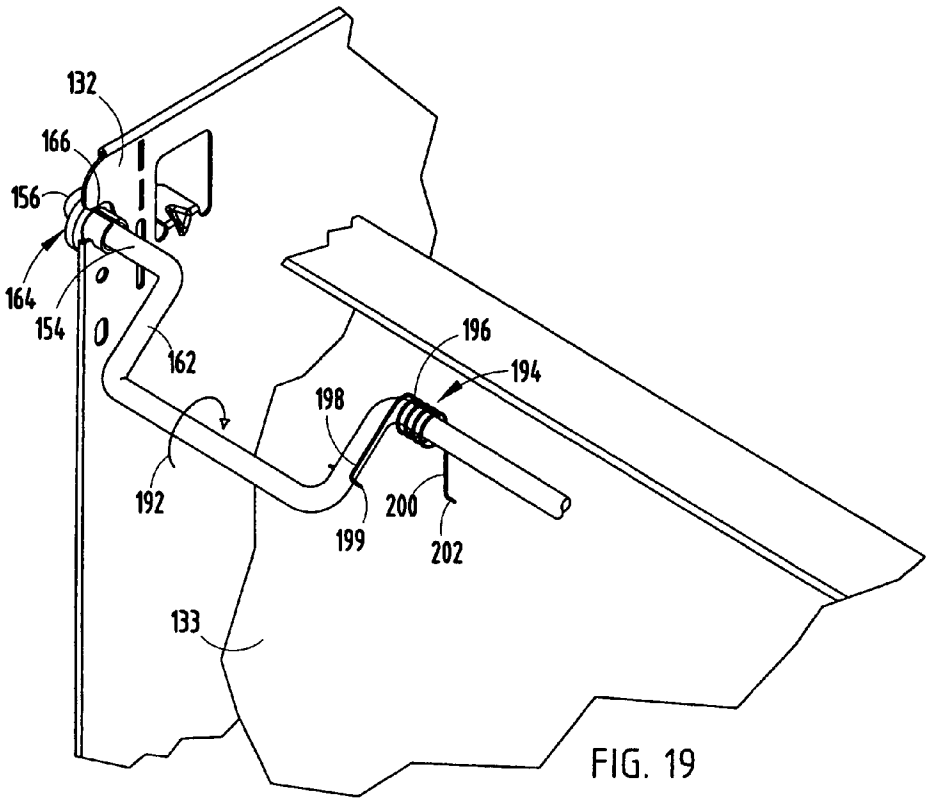
FIG. 19 is a front perspective view of an alternative embodiment of the drawer assembly.

Alternatively, a coil spring 194 (FIG. 19) is used in place of the coil spring 182. The coil spring 194 includes a coiled body portion 196, a first leg 198 having a hook-shaped distal end 199, and a second leg 200 having an orthogonally-extending abutment portion 202. In assembly, the coiled body portion 196 of the coil spring 194 is positioned about the body portion 154 of the locking rod 150 such that the hook-shaped distal end 199 of the first leg 198 receives the actuator portion 162 of the locking rod 150 therein, and the abutment portion 202 of the second leg 200 abuts a portion of the face plate assembly 133, thereby biasing the locking rod 150 in the direction 192.

Figure 14:
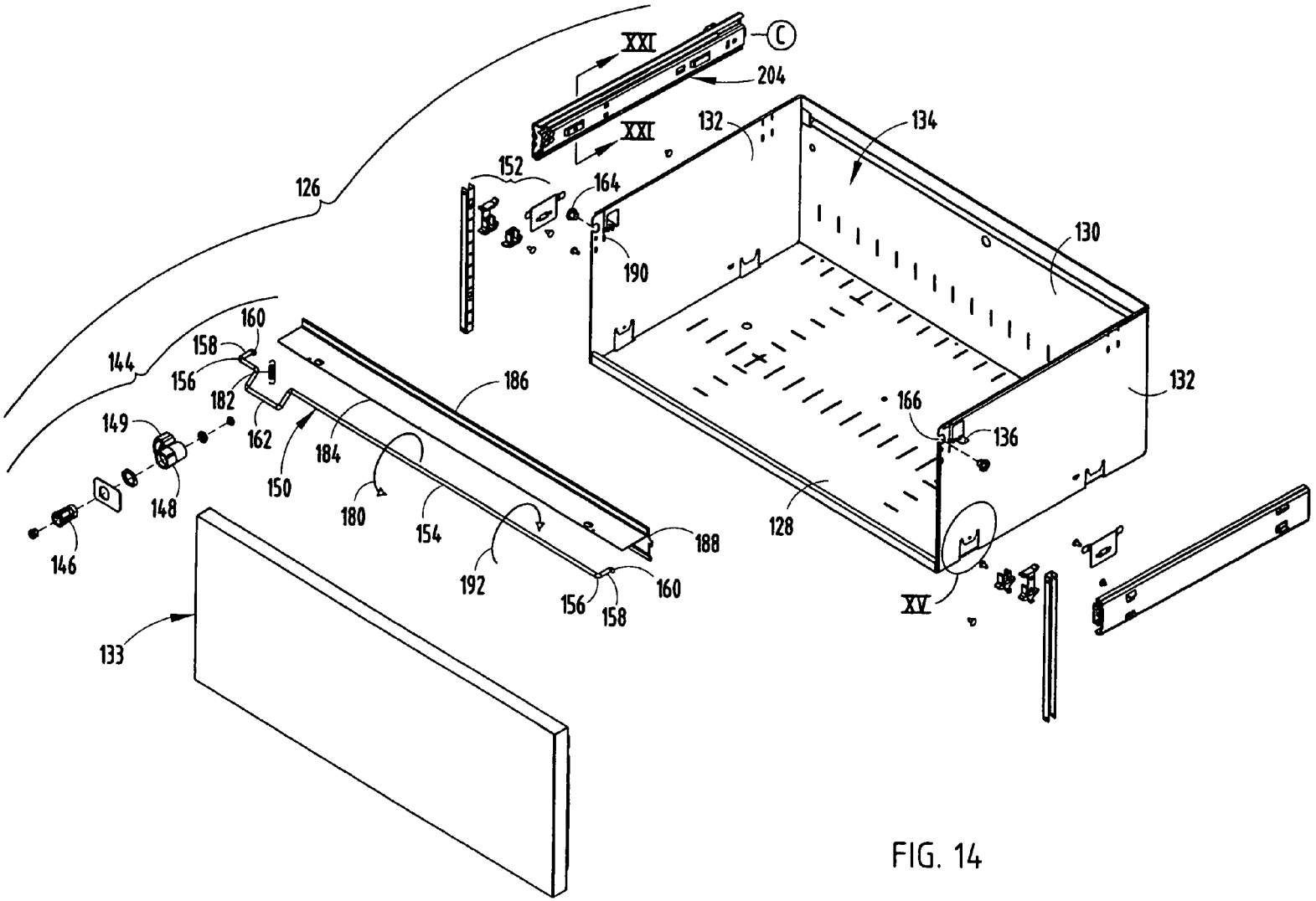
FIG. 14 is an exploded perspective view of a drawer assembly.
Figure 15:
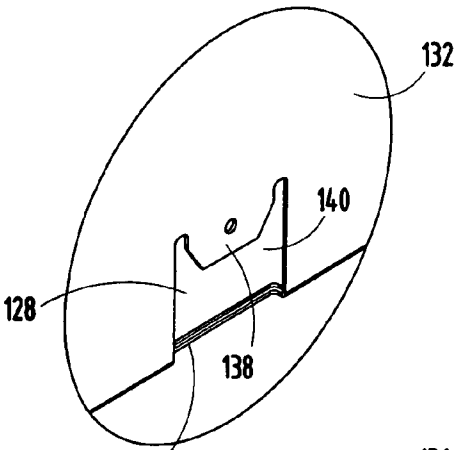
FIG. 15 is an enlarged perspective view of a tab and notch arrangement of the drawer assembly.
Figure 20:
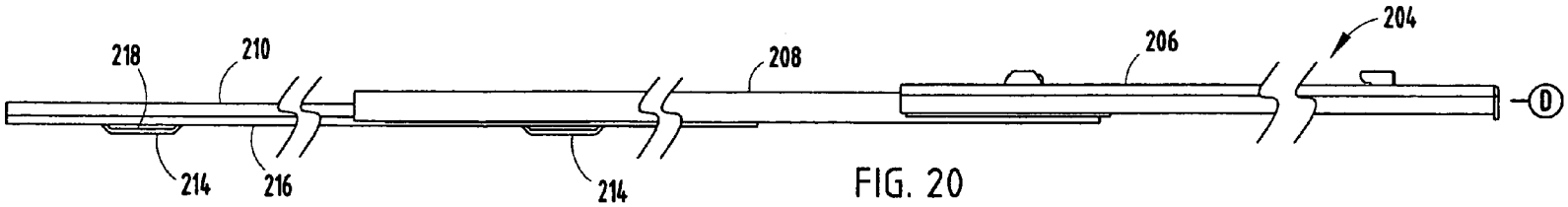
FIG. 20 is a top plan view of a drawer slide assembly in an extended position.
Figure 21:
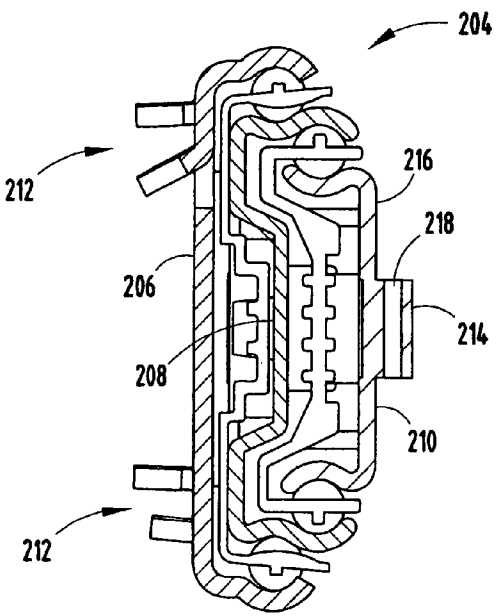
FIG. 21 is a cross-sectional view of a drawer slide assembly taken along the line XXI-XXI, FIG. 20.

Each drawer assembly 126 is slidably supported within the storage area 22 of the housing 12 between the open position A and the closed position B by a pair of drawer slide assemblies 204 (FIG. 14). Each drawer slide assembly 204 is adjustable between a retracted position C (FIG. 13) and an extended position D (FIG. 20), in a manner as is known in the art. In the illustrated example, each drawer slide assembly 204 includes a first rail member 206, a second rail member 208 telescopingly coupled with the first rail member 206 and a third rail member 210 telescopingly coupled with the second rail member 208. The third rail member 210 (FIG. 21) is telescopingly coupled to the second rail member 208, and the second rail member 208 is telescopingly coupled to the first rail member 206 by a plurality of bearings in a manner as is known in the art. Although the illustrated example includes three rail members 206, 208, 210, other operable pluralities of rail members may be utilized. The first rail member 206 includes a plurality of outwardly-extending fasteners 212 that are received within the slots 124 of the forward uprights 114 and the rearward uprights 116, thereby coupling the associated drawer slide assembly 204 with the housing 12 in a manner as is known in the art. The third rail member 210 includes irregularities located along the length thereof, such a protrusion in the form of a pair of spaced-apart, punch-formed loop members 214 extend inwardly from an inner surface 216 of the third rail member 210. Each loop member 214 defines a gap 218 therein.

The illustrated arrangement allows easy drop-in assembly of each drawer assembly 126 with the associated drawer slide assemblies 204. Specifically, subsequent to assembly of the drawer slide assemblies 204 with the forward uprights 114 and rearward uprights 116 of the housing 12, the associated drawer assembly 126 is positioned with respect to the drawer slide assemblies 204 such that the tabs 138 of the sidewalls 132 of the drawer assembly 126 are vertically aligned with the gaps 218 formed by the loop members 214. The drawer assembly 126 is then moved downwardly such that the loop members 214 pass through the apertures or notches 142 located within the bottom wall 128 of the drawer assembly 126 and are received within the apertures or notches 140 of the sidewalls 132 until the tabs 138 are received into the gaps 218 of the drawer slide assemblies 204, thereby coupling the drawer assembly 126 with the drawer slide assemblies 204.

Figure 23:
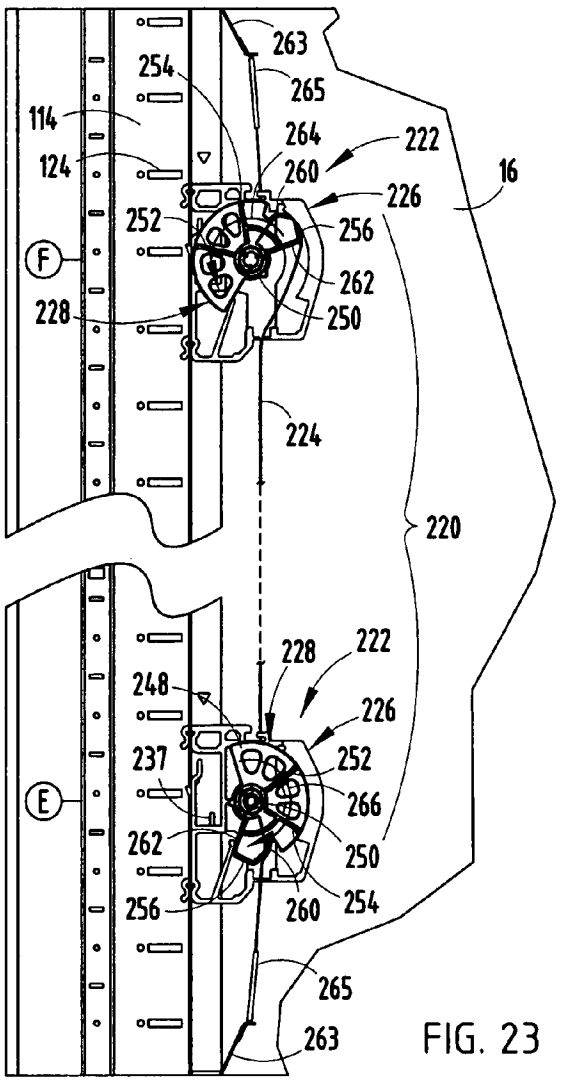
FIG. 23 is a side a view of a pair of drawer interlocks and a ribbon member of the drawer interlock assembly.
Figure 22:
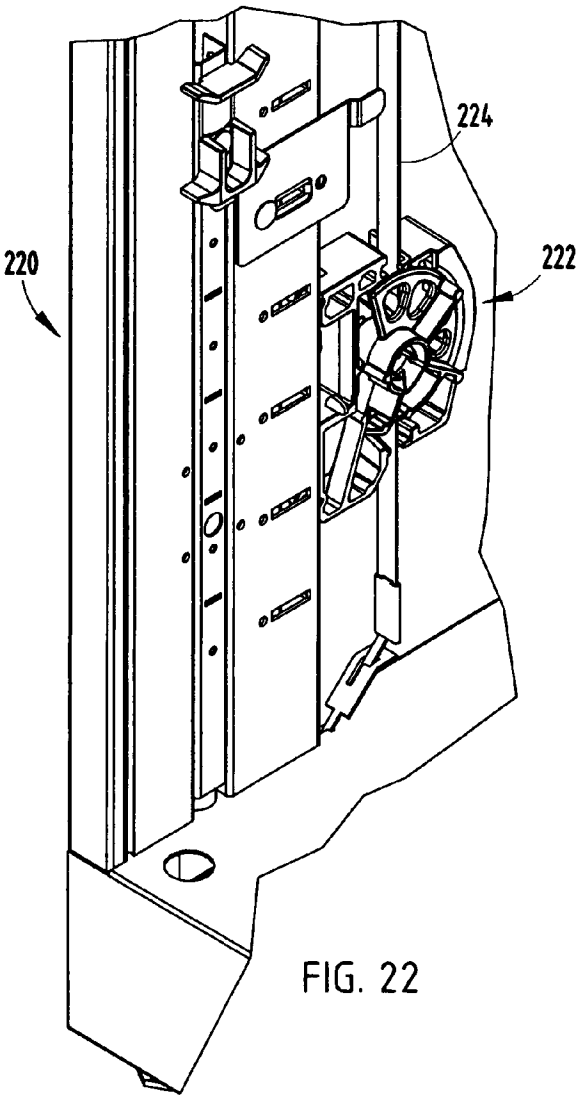
FIG. 22 is a enlarged perspective view of a portion of a drawer interlock assembly.
Figure 24:
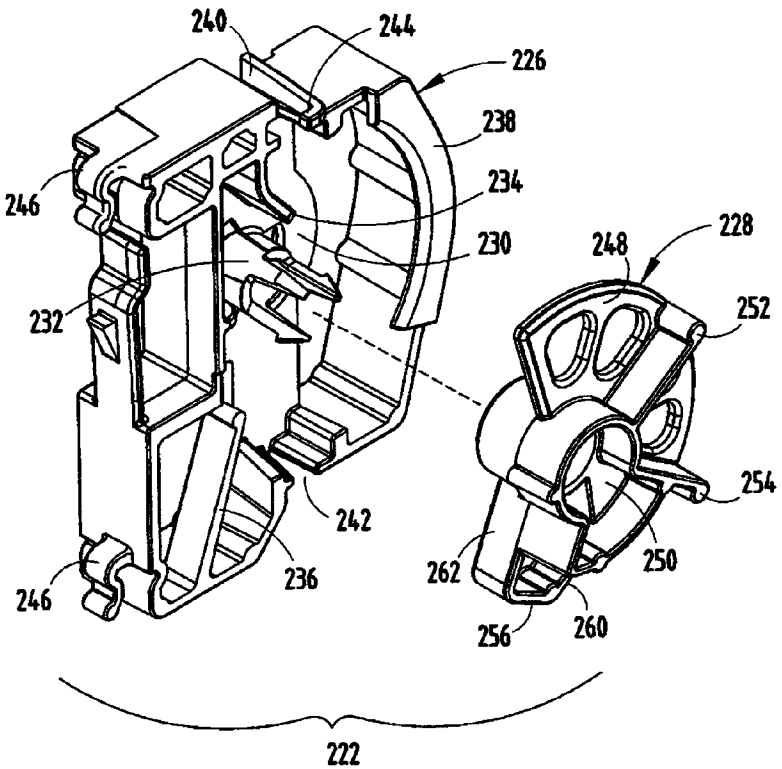
FIG. 24 is an exploded perspective view of one of the drawer interlocks.
Figure 29:
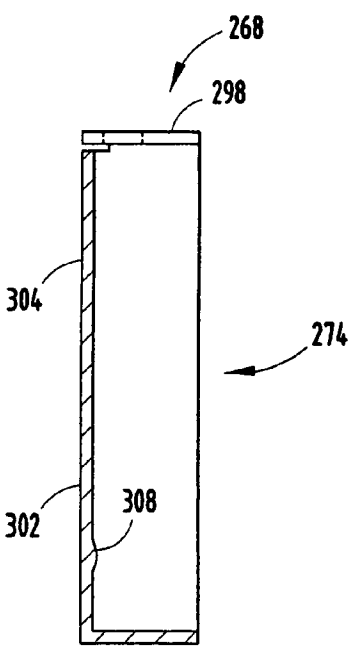
FIG. 29 is a side cross-sectional view of the third hanger bracket taken along the line XXIX-XXIX, FIG. 28.
Figure 28:
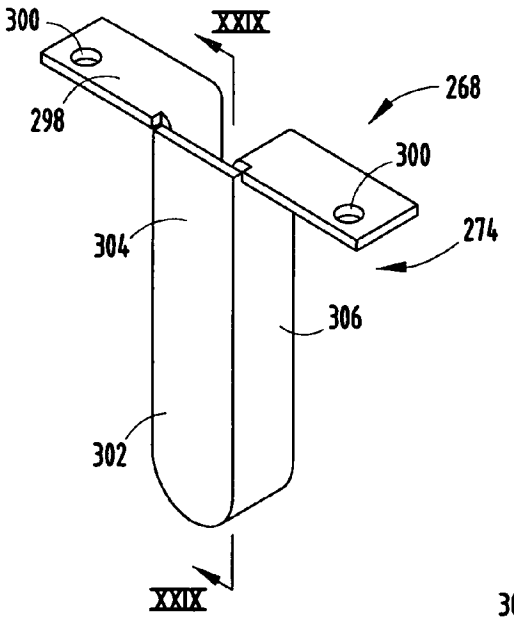
FIG. 28 is top perspective view of a third hanger bracket.
Figure 27:
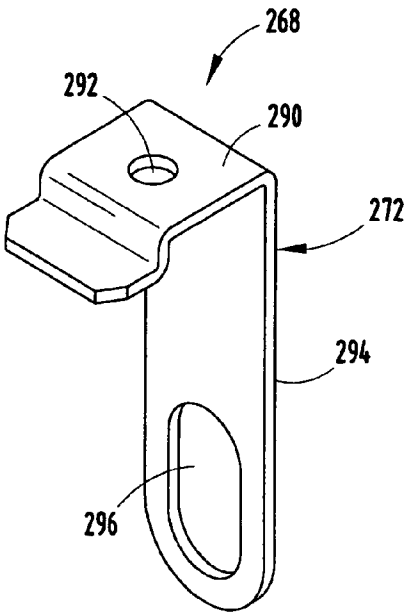
FIG. 27 is a top perspective view of a second hanger rod bracket.
Figure 26:
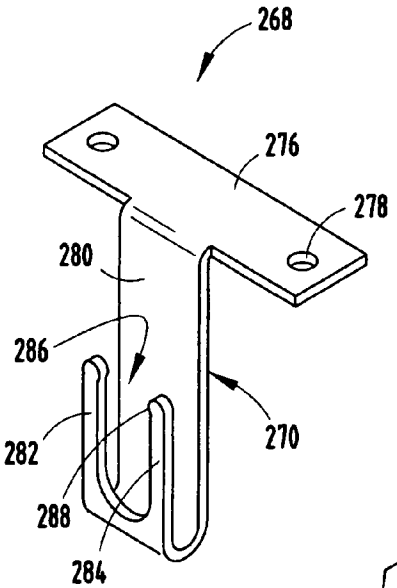
FIG. 26 is a top perspective view of a first hanger rod bracket.

The storage cabinet assembly 10 further includes a drawer interlock assembly 220 (FIG. 22) that includes a plurality of drawer interlocks 222 and flexible, flat ribbon 224 of a given length operably coupling each of the drawer interlocks 222 together. Each of the drawer interlocks 222 (FIGS. 23 and 24) includes an interlock backer or mounting member coupled with one of the forward uprights 114, and a cam member 228 pivotally coupled with the mounting member 226. Each mounting member 226 includes a body portion 230, a centrally-located pivot receiver 232, a first stop member 234 located at a first radial position about the pivot receiver 232, a flexible second stop member 236 located at a second radial position about the pivot receiver 232, and a retention tab or member 237. The mounting member further includes an arcuately-shaped shield wall 238 spanning an arcuate distance about the pivot receiver 232, an upwardly-opening upper slot 240, and a downwardly-opening lower slot 242. An arcuately-shaped guide arm 244 partially encompasses the upper slot 240, so as to retain the ribbon member 224 within the upper slot 240, as described below. The mounting member 226 further includes a pair of downwardly-exposed, forwardly-extending hooks 246 for supporting the associated drawer interlock 222 within the housing 12, as described below.

The cam member 228 includes an arcuately-shaped body portion 248 having a plurality of apertures 259, a pivot aperture 250, a first cam arm 252 extending radially outward from the pivot aperture 250, a second cam arm 254 extending radially outward from the pivot aperture 250, and a cam 256 extending radially outward from the pivot aperture 250. The cam 256 includes a first stop surface 262 and a second stop surface 260.

Figure 25:
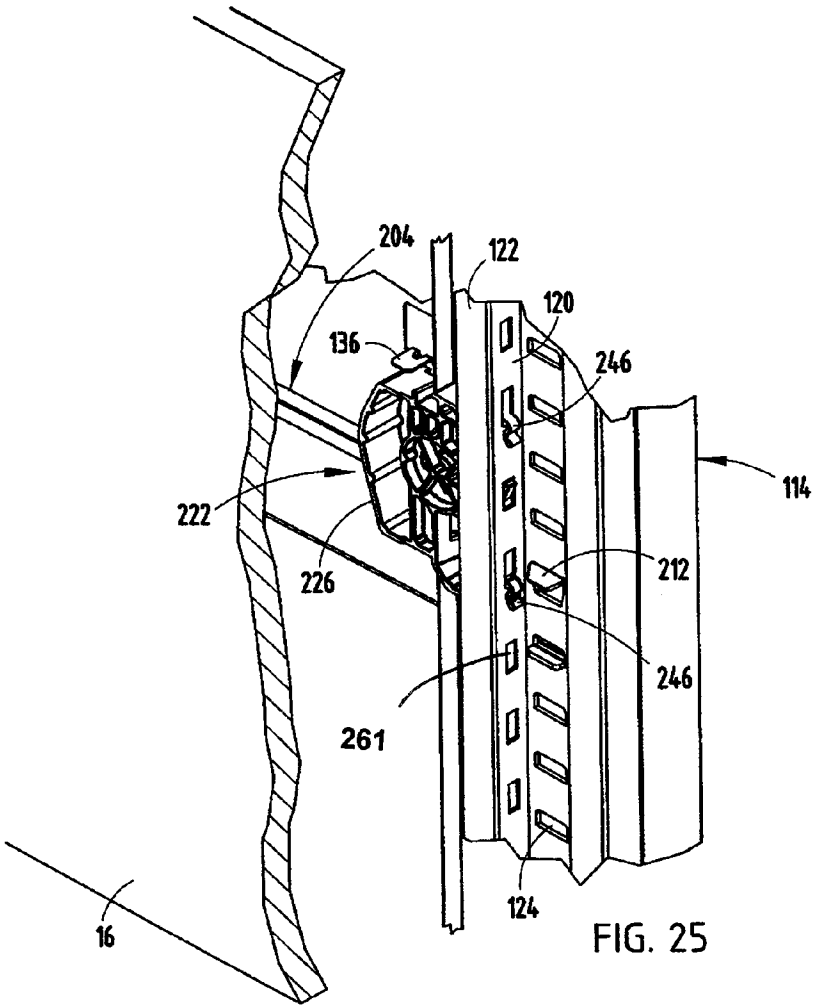
FIG. 25 is an enlarged perspective view of one of the vertical uprights, one of the drawer slide assemblies and one of the drawer interlocks with a portion of a sidewall of the storage cabinet assembly cut away to show internal components.

In assembly, the cam member 228 is pivotally coupled with the associated mounting member 226 by inserting the pivot receiver 232 of mounting member 226 into the pivot aperture 250 of the cam member 228. Each drawer interlock 222 (FIG. 25) is coupled with the associated forward upright 114 by inserting each of the hooks 246 of each mounting member 226 into apertures 261 located within and spaced longitudinally along the rearwardly-facing side surface 120 of one of the forward uprights 114, and the ribbon member 224 is coupled through the plurality of drawer interlocks 222. An associated drawer slide assembly 204 is then assembled with the uprights 114, 116 by inserting the fasteners 212 thereof into the slots 124 of the uprights 114, 116, thereby sandwiching or trapping a portion of the mounting member 226 between the sidewall 16 of the housing 12 and the drawer slide assembly 204 and preventing removal of the drawer interlock 222. Each drawer assembly 126 is then assembled with the drawer slide assemblies 204. Specifically, each drawer assembly 126 is assembled with an associated pair of drawer slide assemblies 204 when the assemblies are in the extended position D. As the drawer assembly 126 is moved to the closed position B, the actuator member 136 contacts the cam member 228 moving the cam member 228 in a clockwise direction of rotation from the position F to a position slightly past the position F, thereby allowing the drawbar assembly 126 to fully close and returning the cam member 228 to the position E.

The ribbon member 224 includes ends 263 that are securely coupled to the forward upright 114. Alternatively, an extension member 265 is coupled to the end 263 of the ribbon member 224, thereby extending the overall useful length of the ribbon member 224 and allowing the ribbon member 224 to be utilized within housings of differing height. The ribbon member 224 is operably received into each of the drawer interlocks 222. Specifically, the ribbon member 224 is received into both the upper slots 240 and the lower slots 242, and is received about the collar portion 249. In operation, the ribbon member 224 is provided a slight slack when each of the drawer assemblies 126 are in the closed position B. Any slack available in the ribbon member 224 is taken up or removed by the opening of a single drawer assembly 126 thereby preventing any other drawer assembly 126 from being simultaneously opened. Specifically, the first cam arm 252 extends into a path as followed by the actuator member 136 of the drawer assembly 126 when the drawer assembly is moved from the closed position A to the closed position B, causing the cam member 228 to rotate from a first position E to a second position F, and the cam 256 of the cam member 228 to abut the ribbon member 224, thereby removing any slack in the same. The cam member 228 continues to rotate until the first cam arm 252 is positioned so as to allow the actuator member 136 to disengage the same, thereby allowing the drawer assembly 126 to be moved to the open position A. The cam member 228 is prevented from over rotating in a direction 264 by abutment of the second stop surface 260 of the cam 256 with the first stop member 234 of the mounting member 226. Misalignment of the cam member 256 while the drawer assembly 126 is in the open position A is prevented by engagement of the retention member 237 into one of the apertures 259 of the cam member 228. The cam member 228 is moved from the second position F to the first position E when the drawer assembly 126 is moved from the open position A to the closed position B and the actuator member 136 abuts the second cam arm 224, thereby overcoming the force exerted by the cam member 228 by the retention member 237 and rotating the cam member 228 in a second direction 266. The cam member is prevented from over rotating in the second direction 266 by abutment of the first stop surface 262 of the cam 256 with the second stop member 236. It should be noted that the guide arm 244 assists in maintaining the ribbon member 224 within the upper slot 240, while the shield wall 238 of the mounting member 226 prevents the ribbon member 224 from being misaligned from the cam member 228.

A storage cabinet and assembly 10 further includes a garment rod bracket assembly 268 (FIGS. 26-29) utilized within the storage area 22 of the housing 12. Specifically, in an arrangement where several of the drawers of the storage cabinet assembly 10 are removed and replaced with doors (not shown), the garment rod bracket assembly 268 is provided so as to allow hanging of garments within the storage area 22. The bracket assembly 268 comprises three hanger brackets each secured to a bottom surface of the top wall 20 of the housing 12, and includes a first hanger bracket 270, a second hanger bracket 272, a third hanger bracket 274, and a hanger rod (not shown) supported by the brackets 270, 272, 274.

The first hanger bracket 270 includes a planar support portion 276 having a plurality of mechanical fastener-receiving apertures 278 extending therethrough, and a body portion 280 extending orthogonally downward from the support portion 276. An integrally-formed U-shaped hook portion 282 extends upwardly from a lower end of the body portion 280 and is formed by a pair of flexibly-resilient, upwardly-extending legs 284. The legs cooperate to form an U-shaped notch 286 and each include an inwardly-extending detent 288 located proximate a distal end thereof.

The second or intermediate hanger bracket 272 includes a support portion 290 having a mechanical fastener-receiving aperture 292 extending therethrough, and an integrally-formed body portion 294 extending orthogonally downward from the support portion 290. A lower end of the body portion 290 includes an oval-shaped aperture 296 extending therethrough.

The third hanger bracket 274 includes a support portion 298 having a pair of mechanical fastener-receiving apertures extending therethrough, and a body portion 302 extending orthogonally downward from the support portion 298 and having an end wall 304 and a U-shaped rim portion 306 extending about the periphery of the wall 304. The body portion 302 is integrally formed with the support portion 298. The end wall includes an inwardly-facing detent 308 located proximate an end of the end wall 304.

In assembly, the hanger rod is positioned with the hanger brackets 270, 272, 274 such that an end of the hanger rod is received within the rim portion 306 of the third hanger bracket 274, and the hanger rod extends through the aperture 296 of the second hanger bracket 272. It is noted that the elongated aperture 296 allows slight vertical adjustment of the hanger rod once positioned therein. An opposite end of the hanger rod is then lowered into snapping engagement within the notch 286 of the first hanger bracket 270 while the first end of the hanger rod is snappingly engaged within the rim portion 306 of the third hanger bracket 274, with the detents 288, 308 engaging the hanger rod.

The present inventive storage cabinet assembly provides a relatively low cost, easy-to-assemble base assembly for supporting an associated housing thereon, that simultaneously provides adequate support for significantly heavy loads. The storage cabinet assembly further provides a drop-in drawer arrangement allowing quick assembly of the drawers with the drawer supporting structure of the storage cabinet assembly by unskilled personnel without the use of specialized tools. Still further, the storage cabinet assembly includes a drawer interlock assembly that prevents the misalignment of associated components within the interlock assembly while associated drawers are moved between opened and closed positions.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A storage cabinet assembly, comprising:

a housing, comprising:

a pair of sidewalls;

a rear wall;

a bottom wall; and a top wall that cooperates with the sidewalls, the rear wall and the bottom wall to form a storage area;

a pair of uprights fixedly secured to the sidewalls disposed across the housing from one another;

a pair of drawer slide assemblies each including a first rail member operably coupled to one of the uprights, and a second rail member telescopingly coupled to the first rail member;

at least two drawers operably coupled to the second rail member of each drawer slide assembly and moveable between an open position, wherein at least a portion of the drawer extends outwardly from within the storage area, and a closed position, wherein the drawer is retracted into the storage area, each drawer including an actuator member; and a drawer interlock assembly for preventing the simultaneous opening of two drawers, the drawer interlock including a mounting member operably coupled to one of the uprights adjacent each drawer, a cam pivotably coupled to the mounting member adjacent each drawer, each cam moving from a first position to a second position when the drawer is moved from the closed position to an open position, and from the second position to the first position when the drawer is moved from the open position to the closed position, each cam operably coupled with the other cams such that the movement of one cam from the first position to the second position prevents movement of the other cams from the first position to the second position, and wherein at least a portion of the mounting member is positioned between one of the drawer slide assemblies and one of the uprights and is held in position by abutment with the drawer slide assembly.

2. The storage cabinet assembly of claim 1, wherein each upright includes an inner surface and at least one side surface each exposed to the storage area, the at least one side surface includes a plurality of apertures spaced along a length thereof, and the mounting member includes at least one engagement member engaging an aperture within the side surface of the upright, thereby supporting the drawer interlock assembly from the upright.

3. The storage cabinet assembly of claim 2, wherein the at least one engagement member of the mounting member includes a pair of engagement members spaced from one another and engaging a pair of the apertures in the side surface of the upright.

4. The storage cabinet assembly of claim 2, wherein the inner surface of each upright includes a plurality of apertures spaced along a length thereof, and wherein the first rail member includes at least one tab engaging one of the apertures of the inner surface.

5. The storage cabinet assembly of claim 1, wherein each upright includes an inner surface having a plurality of apertures spaced along a length thereof, and wherein the first rail member includes at least one tab engaging one of the apertures of the inner surface.

6. The storage cabinet assembly of claim 1, wherein the upright comprises a hat-shaped cross-sectional configuration.

* * * * *

UNITED STATES PATENT AND TRADEMARK OFFICE

CERTIFICATE OF CORRECTION

PATENT NO. : 7,481,503 B2
APPLICATION NO. : 11/335269
DATED : January 27, 2009
INVENTOR(S) : Youngs et al.

It is certified that error appears in the above-identified patent and that said Letters Patent is hereby corrected as shown below:

Column 2;
Line 19, “engage” should be --engages--.

Column 3;
Lines 12 and 13, “effecting” should be --affecting--.
Line 36, “moved” should be --move--.
Line 48, “effecting” should be --affecting--.

Column 4;
Line 54, After “Fig. 10” insert --is--.
Line 56, After “Fig. 11” insert --is--.
Line 58, After “Fig. 12” insert --is--.

Column 5;
Line 12, “XXI-XXI” should be --XIV-XIV--.
Line 13, “a” (1st occurrence) should be --an--.
Line 15, Delete “a” (second occurrence).
Line 54, After “employed” insert --.--.

Column 6;
Line 27, “abuts” should be --abut--.

Column 7;
Line 56, “allow” should be --allows--.

UNITED STATES PATENT AND TRADEMARK OFFICE

CERTIFICATE OF CORRECTION

PATENT NO. : 7,481,503 B2
APPLICATION NO. : 11/335269
DATED : January 27, 2009
INVENTOR(S) : Youngs et al.

It is certified that error appears in the above-identified patent and that said Letters Patent is hereby corrected as shown below:

Column 8;
Line 48, "turns actuate" should be --turn actuates--.

Column 11;
Line 33, "closed" (first occurrence) should be --open--.

Signed and Sealed this

Fifth Day of May, 2009

John Doll

JOHN DOLL
*Acting Director of the United States Patent and Trademark Office*